US011602205B2

(12) United States Patent
Maman

(10) Patent No.: US 11,602,205 B2
(45) Date of Patent: Mar. 14, 2023

(54) MODULAR BAG ASSEMBLIES

(71) Applicant: Eden Maman, Naale (IL)

(72) Inventor: Eden Maman, Naale (IL)

( * ) Notice: Subject to any disclaimer, the term of this patent is extended or adjusted under 35 U.S.C. 154(b) by 380 days.

(21) Appl. No.: 16/628,040

(22) PCT Filed: Aug. 14, 2018

(86) PCT No.: PCT/IL2018/050900
§ 371 (c)(1),
(2) Date: Jan. 2, 2020

(87) PCT Pub. No.: WO2019/035127
PCT Pub. Date: Feb. 21, 2019

(65) Prior Publication Data

US 2020/0305565 A1 Oct. 1, 2020

Related U.S. Application Data

(60) Provisional application No. 62/544,931, filed on Aug. 14, 2017.

(51) Int. Cl.
*A45C 7/00* (2006.01)
*A45C 3/06* (2006.01)
(Continued)

(52) U.S. Cl.
CPC ..... *A45C 7/0077* (2013.01); *A45C 3/06* (2013.01); *A45C 7/009* (2013.01); *A45C 7/0086* (2013.01); *A45C 13/103* (2013.01); *A45C 13/30* (2013.01); *A45C 2013/303* (2013.01); *A45C 2013/306* (2013.01)

(58) Field of Classification Search
CPC ..... A45C 7/0077; A45C 3/0086
See application file for complete search history.

(56) References Cited

U.S. PATENT DOCUMENTS 3,061,057 A * 10/1962 Charles ..... A45C 7/0086 190/110
4,081,061 A * 3/1978 Tucker ..... A45C 3/00 383/17

(Continued)

OTHER PUBLICATIONS

Brightline Bags Brochure (Year: 2016).*

(Continued)

*Primary Examiner* — Jennifer Robertson
*Assistant Examiner* — Justin Caudill
(74) *Attorney, Agent, or Firm* — Mark M. Friedman

(57) ABSTRACT

A handbag includes first and second side panels. The first side panel includes oppositely disposed first and second outer sidewalls. A first zipper arrangement of a first profile is coupled to the first outer sidewall. A second zipper arrangement of the first profile is coupled to the second outer sidewall. The second side panel includes oppositely disposed first and second outer sidewalls. A first zipper arrangement of a second profile coupled to the first outer sidewall of the second side panel member. A second zipper arrangement of the second profile coupled to the second outer sidewall of the second side panel member. The zipper arrangements of the first profile can engage with each of the zipper arrangements of the second profile. A compartment is formed by one of the outer sidewalls of the first and second side panels.

20 Claims, 26 Drawing Sheets

(51) Int. Cl.
*A45C 13/10* (2006.01)
*A45C 13/30* (2006.01)

(56) References Cited

U.S. PATENT DOCUMENTS

| | | | | |
|---|---|---|---|---|
| 5,186,290 | A * | 2/1993 | Takayama | A45C 7/0045 190/110 |
| 5,509,515 | A * | 4/1996 | Guo | A45C 7/009 190/110 |
| 6,213,267 | B1 * | 4/2001 | Miller | A45C 7/0086 190/110 |
| 7,322,477 | B2 * | 1/2008 | Schweitz | B62B 1/26 150/111 |
| 10,716,374 | B1 * | 7/2020 | Salibi | A45C 13/103 |
| 2005/0103817 | A1 * | 5/2005 | Glankler | A45C 13/1092 224/583 |
| 2007/0022540 | A1 * | 2/2007 | Hochschild | A47C 27/001 5/738 |
| 2013/0087423 | A1 | 4/2013 | Bettua et al. | |
| 2015/0075683 | A1 * | 3/2015 | Meuller-Heumann | A45C 7/00 493/243 |
| 2015/0237978 | A1 * | 8/2015 | Forget | A45C 5/005 190/115 |
| 2017/0251771 | A1 * | 9/2017 | Wang | A45C 7/0027 |

OTHER PUBLICATIONS

Brightline Bags FLEX brochure. (Year: 2016).*

Aero Nerds Brightline Flight Bag Review: https://www.youtube.com/watch?v=ILbm4ITZyYk&t=1350s (Year: 2019).*

MyPilotStore: "Brightline Bags B7 Flight Pilot Bag 8:26" Youtube—MyPilotStore Channel, [Online] URL: <https://www.youtube.com/watch?v=A2j-Jp4fOCI> (Year: 2014).*

Brightline Bags: "Flex System Overview 3:16" URL: <https://www.youtube.com/watch?v=pVtssXUvEU8> (Year: 2014).*

MyPilotStore: "Brightline Bags B7 Flight Pilot Bag 8:26" Youtube—MyPilotStore Channel, [Online], Sep. 19, 2014 (Sep. 19, 2014) [Retrieved on Oct. 21, 2018] Retrieved from the Internet at URL:< https://www.youtube.com/watch?v=A2j-Jp4fOCI> MyPilotStore Sep. 19, 2014 (Sep. 19, 2014).

Retrieved from the Internet at URL: <https://web.archive.org/web/20 I 60323181248/https://www.brightlinebags.com/> (Mar. 23, 2016) [Retrieved on Oct. 21, 2018] Mar. 23, 2016(Mar. 23, 2016).

BrightLine Bags: "FLEX System Overview 3: 16" Youtube—BrightLine Bags Channel, [Online], Jul. 25, 2014 (Jul. 25, 2014) [Retrieved on Oct. 21, 2018] Retrieved from the Internet at URL:< https://www.youtube.com/watch?v=pVtssXUvEU8> BrightLine Bags Jul. 25, 2014 (Jul. 25, 2014).

* cited by examiner

MODULAR BAG ASSEMBLIES

CROSS-REFERENCE TO RELATED APPLICATIONS

This application claims priority from U.S. Provisional Patent Application No. 62/544,931, filed Aug. 14, 2017, whose disclosure is incorporated by reference in its entirety herein.

TECHNICAL FIELD

The present invention relates to modular handbags.

BACKGROUND OF THE INVENTION

Various types of handbags are known in the art. Conventional handbags are available in a variety of shapes and sizes, however, each individual handbag is limited to the size and basic functionality with which the handbag was originally designed. Alternative handbags have been presented which allow users to attach various additional components and accessories to customize handbags, however, the attachment configurations are restricted and present the user with a limited number of possible configurations.

SUMMARY OF THE INVENTION

The present invention is a plurality of modular handbag assemblies.

According to the teachings of an embodiment of the present invention, there is provided a handbag assembly. The handbag assembly comprises: a first side panel member including: oppositely disposed first and second outer sidewalls, a first zipper arrangement of a first profile coupled to the first outer sidewall along a peripheral portion thereof, and a second zipper arrangement of the first profile coupled to the second outer sidewall along a peripheral portion thereof, the first and second zipper arrangements of the first profile being inversely oriented to each other, and each of the zipper arrangements of the first profile including a plurality of teeth extending substantially between a first end and a second end; a second side panel member including: oppositely disposed first and second outer sidewalls, a first zipper arrangement of a second profile coupled to the first outer sidewall of the second side panel member along a peripheral portion thereof, and a second zipper arrangement of the second profile coupled to the second outer sidewall of the second side panel member along a peripheral portion thereof, the first and second zipper arrangements of the second profile being inversely oriented to each other, and each of the zipper arrangements of the second profile including a plurality of teeth extending substantially between a first end and a second end, each of the zipper arrangements of the first profile being configured to engage with each of the zipper arrangements of the second profile to form a zipper fastening arrangement and create a compartment defined in part by at least one of the outer sidewalls of the first side panel and at least one of the outer sidewalls of the second side panel.

Optionally, the engaging is defined in part by interlocking between the teeth of the at least one of the zipper arrangements of the first profile and the at least one of the zipper arrangements of the second profile.

Optionally, each of the zipper arrangements of the first profile further includes a retainer box deployed at the first end, an end post deployed at the second end, and a slider for moving along the teeth between the first and second ends, and each of the zipper arrangements of the second profile further including an insertion pin deployed at the first end, and an end post deployed at the second end.

Optionally, the engaging is defined in part by insertion of the insertion pin of one of the zipper arrangements of the second profile into the retainer box of one of the zipper arrangements of the first profile, and movement of the slider from the first end to the second end of one of the zipper arrangements of the first profile.

Optionally, the teeth of each zipper arrangement of the first profile are arranged in a substantially closed loop, and movement of the slider from the first end to the second end of each zipper arrangement of the first profile being in a clockwise direction along the closed loop.

Optionally, the teeth of each zipper arrangement of the first profile are arranged in a substantially closed loop, and movement of the slider from the first end to the second end of each zipper arrangement of the first profile being in a counter-clockwise direction along the closed loop.

Optionally, the handbag assembly further comprises a central member having a plurality of sidewalls including at least oppositely disposed first and second outer sidewalls, the central member further including a third zipper arrangement of the second profile coupled to the first outer sidewall along a peripheral portion thereof, and a third zipper arrangement of the first profile coupled to the second outer sidewall along a peripheral portion thereof.

Optionally, the third zipper arrangement of the second profile is configured to engage with at least one of the first and second zipper arrangements of the second profile to form a second zipper fastening arrangement and create a compartment defined in part by the first outer sidewall of the central member and at least one of the outer sidewalls of the first side panel, and the third zipper arrangement of the first profile being configured to engage with at least one of the first and second zipper arrangements of the first profile to form a third zipper fastening arrangement and create a compartment defined in part by the second outer sidewall of the central member and at least one of the outer sidewalls of the second side panel and the first outer sidewall of the central member.

Optionally, each of first and second outer sidewalls of each of the first and second side panels includes a pair of strap attachment mechanisms.

There is also provided according to an embodiment of the teachings of the present invention a handbag assembly. The handbag assembly comprises: a central member having a plurality of sidewalls including at least oppositely disposed first and second outer sidewalls, a first zipper arrangement of a first profile being coupled to one of the outer sidewalls along a peripheral portion thereof, and a first zipper arrangement of a second profile being coupled to the other outer sidewall along a peripheral portion thereof; and at least one add-on side panel member including oppositely disposed first and second outer sidewalls, a second zipper arrangement of the first or second profile being coupled to the first outer sidewall along a peripheral portion thereof, and a third zipper arrangement of the first or second profile being coupled to the second outer sidewall along a peripheral portion thereof, at least one of the second zipper arrangements of the first or second profiles being configured to engage with the first of the zipper arrangements of the second or first profile to form a zipper fastening arrangement and create a compartment defined in part by at least one of the outer sidewalls of the central member and at least one of the outer sidewalls of the second side panel member.

Optionally, the central member further includes a first inner sidewall oppositely disposed from the first outer sidewall, and a second inner sidewall oppositely disposed from the second outer sidewall, and a compartment defined in part by the first and second inner sidewalls.

Optionally, the central member further includes a third inner sidewall and a third outer sidewall oppositely disposed from the third inner sidewall, and the compartment being further defined in part by the third inner sidewall.

Optionally, the central member has a substantially triangular cross section through a first plane.

Optionally, the central member has a substantially square or rectangular cross section through a second plane normal to the first plane.

There is also provided according to an embodiment of the teachings of the present invention a handbag assembly. The handbag assembly comprises: a base panel member including oppositely disposed first and second outer sidewalls, the base panel member including: a plurality of strap attachment mechanisms deployed on the first and second outer sidewalls for detachably receiving a plurality of straps, a first zipper arrangement of a first profile coupled to the first outer sidewall along a peripheral portion thereof, and a second zipper arrangement of the first profile coupled to the second outer sidewall along a peripheral portion thereof; and a first add-on panel member including at least one outer sidewall and a first zipper arrangement of a second profile coupled to the at least one outer sidewall along a peripheral portion thereof, the first zipper arrangement of the second profile being configured to engage with each of the zipper arrangements of the first profile to form a zipper fastening arrangement and create a compartment defined in part by the at least one outer sidewall and at least one of the outer sidewalls of the first add-on panel member.

Optionally, the handbag assembly further comprises a second add-on panel member including oppositely disposed first and second outer sidewalls, the second add-on panel member having a third zipper arrangement of the first profile coupled to the first outer sidewall of the second add-on panel member along a peripheral portion thereof, and having a second zipper arrangement of the second profile coupled to the second outer sidewall of the second add-on panel member along a peripheral portion thereof.

Optionally, the handbag assembly further comprises a flap member removably attachable to the base panel member and the first add-on panel member.

Optionally, the flap member includes: a central portion having a compartment with an opening at a first peripheral edge of the central portion, and a first foldable portion and a second foldable portion, each foldable portion configured to fold along a respective peripheral edge of the central portion that is adjacent to the first edge.

Unless otherwise defined herein, all technical and/or scientific terms used herein have the same meaning as commonly understood by one of ordinary skill in the art to which the invention pertains. Although methods and materials similar or equivalent to those described herein may be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the present invention are herein described, by way of example only, with reference to the accompanying drawings. With specific reference to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

Attention is now directed to the drawings, where like reference numerals or characters indicate corresponding or like components. In the drawings.

DESCRIPTION OF THE PREFERRED EMBODIMENTS

Figure 1:
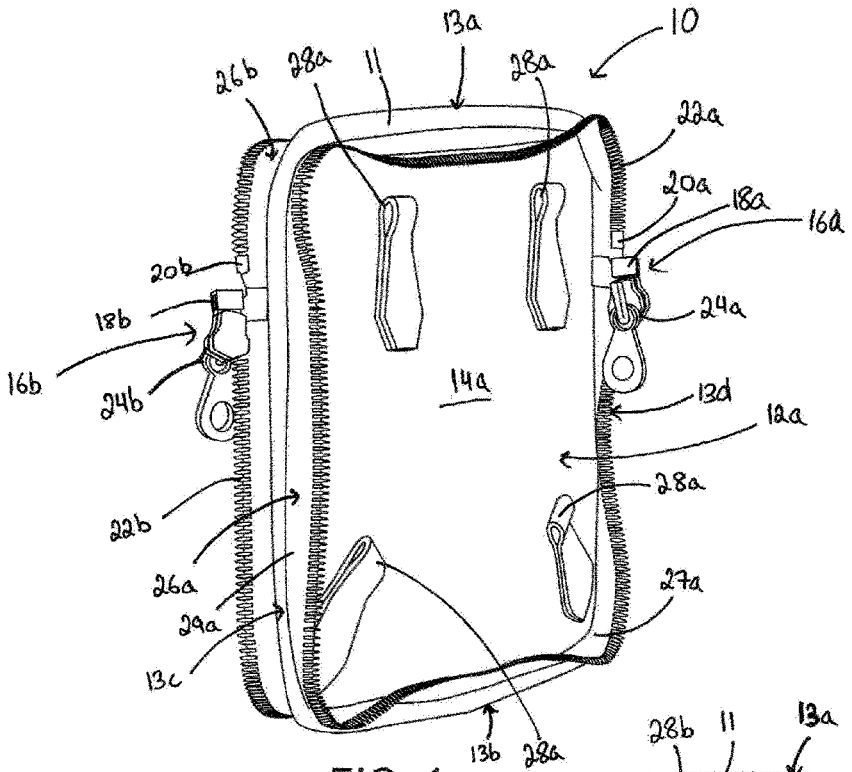
FIG. 1 is an isometric view of a rear side panel, constructed and operative according to an embodiment of the present invention, showing a first side of the rear side panel.

The present invention is a plurality of modular handbag assemblies.

Within the context of this document, the term "handbag" generally refers to any hand-carried, hand-drawn, shoulder-carried, back-carried, or hand-dragged bag structure, typically constructed from a fabric or similar material. A "handbag" may include bags including, but not limited to, purses, clutches, shoulder bags, luggage, suitcases, duffle bags, backpacks, and the like.

As will be described, the handbag assemblies of the present disclosure include various interchangeable and interconnectable major components, namely, one or more side panels which can be attached to each other and/or attached to one or more central (or base) members. In most embodiments, the side panels are reversible side panels. As will be discussed in further detail below, each of the major components includes at least one zipper arrangement of either a first or second profile. In embodiments in which a side panel is a reversible side panel, two zipper arrangements of the same profile are deployed, one on each side of the side panel, in an inverse orientation relative to each other.

Each of the zipper arrangements of the first profile includes a plurality of zipper teeth (i.e., teeth) arranged to form a zipper track, a retainer box deployed at a first end of the zipper track, an end post deployed at a second end of the zipper track, and a slider for moving between the two ends of the zipper track. As with typical zippers, a pull tab is connected to the slider to facilitate movement of the slider. Each of the zipper arrangements of the second profile includes a plurality of zipper teeth (i.e., teeth) arranged to form a zipper track, an insertion pin deployed at a first end of the zipper track, and an end post deployed at a second end of the zipper track. In general, throughout the present disclosure, each zipper arrangement of the first profile can engage with each zipper arrangement of the second profile to form a zipper fastening arrangement, unless explicitly stated otherwise. The engagement of a pair of zipper arrangements is effectuated by insertion of the insertion pin into the retainer box, and movement of the slider along the zipper teeth of the zipper arrangement pair.

Efficacy of the above-mentioned engagement of pairs of zipper arrangements is increased, and to a certain degree maximized, when each of the zipper arrangements have counted teeth (i.e., when each of the zipper arrangements includes the same number of teeth). In other words, the handbag assemblies of the present disclosure operate most efficiently when the same number of teeth is present in each zipper arrangement. By utilizing zipper arrangements with counted teeth, smooth engagement of the major components of the handbag assemblies is enabled. Excella zippers, produced by the YKK Group of Tokyo, Japan, are an example of zipper arrangements having counted teeth, and may be used to implement the zipper arrangements according to certain preferred embodiments of the present disclosure.

The principles and operation of the handbag assembly according to the present invention may be better understood with reference to the drawings and accompanying description.

Before explaining at least one embodiment of the invention in detail, it is to be understood that the invention is not necessarily limited in its application to the details of construction and the arrangement of the components and/or methods set forth in the following description and/or illustrated in the drawings and/or the examples. The invention is capable of other embodiments or of being practiced or carried out in various ways. Initially, throughout this document, references are made to directions such as, for example, front and rear, top and bottom, left and right, and the like. These directional references are exemplary only to illustrate the invention and embodiments thereof.

Referring now to the drawings, FIGS. 1-9 show various views of components of a handbag assembly, constructed and operative according to an embodiment of the present disclosure. Generally speaking, the handbag assembly includes at least two reversible side panels, namely a first side panel 10 and a second side panel 30. The first side panel 10 is referred to interchangeably as a rear side panel, and the second side panel 30 is referred to interchangeably as a front side panel. The two side panels 10, 30 are separate members and are reversibly attachable to each other, resulting in at least four different possible attachment configurations of the two side panels. The two side panels 10, 30 may be constructed from a variety of fabrics and materials and may be designed with various colors, emblems, markings, designs, and the like. In general, the two side panels 10, 30 are similar in structure and appearance aside from several key distinguishing features. Notably, the two side panels 10, 30 are distinguished from each other by different engagement mechanisms, and in certain embodiments may also be distinguished by design markings present on the front side panel 30 which are absent from the rear side panel 10.

Figure 2:
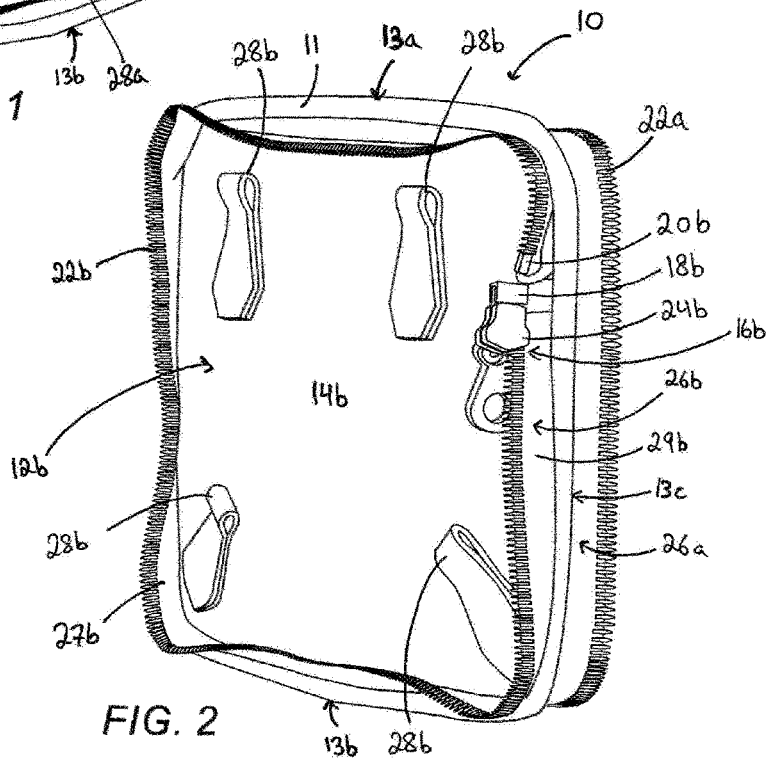
FIG. 2 is an isometric view of the rear side panel of FIG. 1, showing a second side of the rear side panel.
Figure 3:
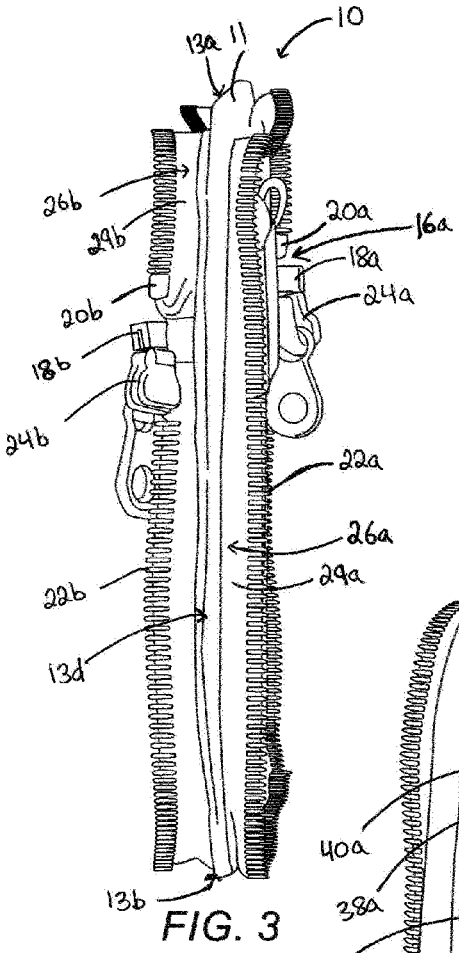
FIG. 3 is a side view of the rear side panel of FIGS. 1 and 2.

FIGS. 1-3 show various views of the rear side panel 10 according to an embodiment of the present disclosure. The rear side panel 10 has two opposing sides, namely a first side 12*a* and a second side 12*b*. According to certain embodiments, the sides 12*a*, 12*b* are integrally formed such that the rear side panel 10 is a single member. A first outer sidewall 14*a* is disposed on the first side 12*a*, and a second outer sidewall 14*b* is disposed on the second side 12*b*. The two sides 12*a*, 12*b* may be constructed from the same fabric/material and have the same color/design, or may be constructed from different fabrics/materials and/or have different colors/designs. The outer sidewalls 14*a*, 14*b* are oppositely disposed from each other, and are generally identical to each other. A central flange 11 extends along the entire perimeter of the rear side panel 10 and bisects the rear side panel 10 along a central plane to separate the rear side panel 10 into the two sides 12*a*, 12*b*. The perimeter of the rear side panel 10 is defined by a plurality of edges, which in the non-limiting exemplary illustration of the rear side panel 10 shown in FIGS. 1-3 includes four such edges, namely a top edge 13*a*, a bottom edge 13*b*, a left edge 13*c*, and a right edge 13*d*. The outer sidewalls 14*a*, 14*b* may be of any geometric shape, and are generally square-shaped in the non-limiting exemplary illustration of the rear side panel 10 shown in FIGS. 1-3.

With particular reference to FIG. 1, the first side 12*a* includes a plurality of strap connectors 28*a* attached to the first outer sidewall 14*a*. In the non-limiting exemplary illustration of the rear side panel 10 in FIG. 1, there are four such strap connectors 28*a* deployed near the corners of the first outer sidewall 14*a*. Each of the strap connectors 28*a* is configured to receive a detachable strap to allow carrying of the handbag assembly on a shoulder or arm, as will be discussed in further detail in subsequent sections of the present disclosure. It is noted that only two strap connectors 28*a* may be present, however, the deployment of four strap connectors 28*a* provides additional functionality to attach straps to allow carrying of the handbag assembly on the back of the user like a backpack.

The first side 12*a* includes a peripheral flange 26*a* having an inner surface 27*a* and an outer surface 29*a*. The peripheral flange 26*a* extends along almost the entire periphery of the first outer sidewall 14*a*, except for a small gap. The peripheral flange 26*a* is attached to the first outer sidewall 14*a* at the central flange 11. The peripheral flange 26*a* is constructed from a material having a degree of flexure, and preferably from a material having elastic properties. The properties of the material from which the peripheral flange 26*a* is constructed allows flexible movement of the peripheral flange 26*a*, whereby the peripheral flange 26*a* can be folded in a first fold configuration so as to bring portions of the inner surface 27*a* into contact with the first outer sidewall 14*a*, and further folded in a second fold configuration whereby the peripheral flange 26*a* is folded over the central flange 11 such that portions of the outer surface 29*a* are folded toward the central flange 11 and onto the edges 13*a-d*.

A first zipper arrangement of a first profile, designated 16*a*, and referred to hereinafter as the zipper arrangement 16*a*, is attached to the peripheral flange 26*a*. The zipper arrangement 16*a* includes a plurality of teeth 22*a* arranged to form a zipper track in a nearly closed loop, where the beginning and end of the nearly closed loop are marked by two respective ends of the zipper track. The zipper arrangement 16*a* is attached to a terminating portion of the peripheral flange 26*a*. The attachment of the zipper arrangement 16*a* to the peripheral flange 26*a* is made, for example, via sewing or stitching, or via adhesive bonding techniques. When the peripheral flange 26*a* is folded in the first fold configuration, the teeth 22*a* are brought towards the first outer sidewall 14*a*, and when the peripheral flange 26*a* is folded in the second fold configuration, the teeth are brought towards the central flange 11. A retainer box 18*a* is deployed at the first end of the zipper track, and an end post 20*a* is deployed at the second end of the zipper track. The end post 20*a* is preferably positioned near the intersection of two of the edges of the rear side panel 10, slightly offset from one of the two edges. In the non-limiting exemplary illustration of the rear side panel 10 shown in FIGS. 1-3, the end post 20*a* is positioned along the right edge 13*d* and a few centimeters (e.g., 3 centimeters) below the top edge 13*a*.

The peripheral flange 26*a* forms nearly a closed loop, such that the two ends of the zipper arrangement 16*a* (i.e., the retainer box 18*a* and the end post 20*a*) are in close proximity to each other. The zipper arrangement 16*a* further includes a slider 24*a* for moving along the teeth 22*a* between the two ends (i.e., between the retainer box 18*a* and the end post 20*a*). As the slider 24*a* moves along the teeth 22*a*, the slider 24*a* is also configured to simultaneously move along a corresponding set of teeth of a corresponding zipper arrangement on the front panel 30, as will be discussed in further detail in subsequent sections of the present disclosure. In the depiction of the rear panel 10 in FIG. 1, the slider 24*a* moves in the clockwise direction from the retainer box 18*a* to the end post 20*a* and moves in the counter clockwise direction from the end post 20*a* to the retainer box 18*a*. Note that the zipper arrangement 16*a* may alternatively be inverted such that the slider 24*a* moves in the counter clockwise direction from the retainer box 18*a* to the end post 20*a* and moves in the clockwise direction from the end post 20*a* to the retainer box 18*a*.

With continued reference to FIG. 1, refer now to FIG. 2, the second side 12*b* of the rear side panel 10. The second side 12*b* includes a plurality of strap connectors 28*b* attached to the second outer sidewall 14*b*. Preferably, the first and second sides 12*a*, 12*b* have the same number of strap connectors 28*a*, 28*b*.

The second side 12*b* includes a peripheral flange 26*b* having an inner surface 27*b* and an outer surface 29*b*. The peripheral flange 26*b* extends along almost the entire periphery of the second outer sidewall 14*b*, except for a small gap. The peripheral flange 26*b* is attached to the second outer sidewall 14*b* at the central flange 11. The peripheral flange 26*b* is constructed from a material having a degree of flexure, and preferably from a material having elastic properties. The properties of the material from which the peripheral flange 26*b* is constructed allows flexible movement of the peripheral flange 26*b*, whereby the peripheral flange 26*b* can be folded in a first fold configuration so as to bring portions of the inner surface 27*b* into contact with the second outer sidewall 14*b*, and further folded in a second fold configuration whereby the peripheral flange 26*b* is folded over the central flange 11 such that portions of the outer surface 29*b* are folded toward the central flange 11 and onto the edges 13*a-d*.

A second zipper arrangement of the first profile, designated 16*b*, and referred to hereinafter as the zipper arrangement 16*b*, is attached to the peripheral flange 26*a*. The zipper arrangement 16*b* includes a plurality of teeth 22*b* arranged to form a zipper track in a nearly closed loop, where the beginning and end of the nearly closed loop are marked by two respective ends of the zipper track. The zipper arrangement 16*b* is attached to a terminating portion of the peripheral flange 26*b*. The attachment of the zipper arrangement 16*b* to the peripheral flange 26*b* is made, for example, via sewing or stitching, or via adhesive bonding techniques. When the peripheral flange 26*b* is folded in the first fold configuration, the teeth 22*b* are brought towards the second outer sidewall 14*b*, and when the peripheral flange 26*b* is folded in the second fold configuration, the teeth are brought towards the central flange 11. A retainer box 18*b* is deployed at the first end of the zipper track, and an end post 20*b* is deployed at the second end of the zipper track. The end post 20*b* is preferably positioned near the intersection of two of the edges of the rear side panel 10, slightly offset from one of the two edges. In the non-limiting exemplary illustration of the rear side panel 10 shown in FIGS. 1-3, the end post 20*b* is positioned along the left edge 13*c* and a few centimeters (e.g., 3 centimeters) below the top edge 13*a*.

The peripheral flange 26*b* forms nearly a closed loop, such that the two ends of the zipper arrangement 16*b* (i.e., the retainer box 18*b* and the end post 20*b*) are in close proximity to each other. The zipper arrangement 16*b* further includes a slider 24*b* for moving along the teeth 22*b* between the two ends (i.e., between the retainer box 18*b* and the end post 20*b*). As the slider 24*b* moves along the teeth 22*b*, the slider 24*b* is also configured to simultaneously move along a corresponding set of teeth of a corresponding zipper arrangement on the front panel 30, as will be discussed in further detail in subsequent sections of the present disclosure. In the depiction of the rear panel 10 in FIG. 1, the slider 24*b* moves in the clockwise direction from the retainer box 18*b* to the end post 20*b* and moves in the counter clockwise direction from the end post 20*b* to the retainer box 18*b*. Note that the zipper arrangement 16*b* may alternatively be inverted such that the slider 24*b* moves in the counter clockwise direction from the retainer box 18*b* to the end post 20*b* and moves in the clockwise direction from the end post 20*b* to the retainer box 18*b*.

It is a particular feature of the handbag assembly of the present disclosure that the zipper arrangements 16*a*, 16*b* be inversely oriented relative to each other. The inverse orientation of the zipper arrangements 16*a*, 16*b* is most clearly observable in FIGS. 1 and 3. The inverse orientation allows the rear side panel 10 to be reversibly attached to the front side panel 30, as will be discussed in further detail in subsequent sections of the present disclosure. Within the context of the present disclosure, the inverse orientation of the zipper arrangements 16*a*, 16*b* generally refers to the configuration in which the retainer box 18*a* and the end post 20*a* are deployed proximate to a first edge of the rear side panel 10, and the retainer box 18*b* and the end post 20*b* are deployed proximate to a second edge of the rear side panel 10, different from the first edge. In geometries in which the outer sidewalls 14*a*, 14*b* are square-shaped, the different edges are opposite edges. In the non-limiting exemplary illustration of the rear side panel 10 shown in FIGS. 1-3, the retainer box 18*a* and the end post 20*a* are deployed at or near the upper portion of the right edge 13*c*, and the retainer box 18*b* and the end post 20*b* are deployed at or near the upper portion of the left edge 13*d*.

Figure 4:
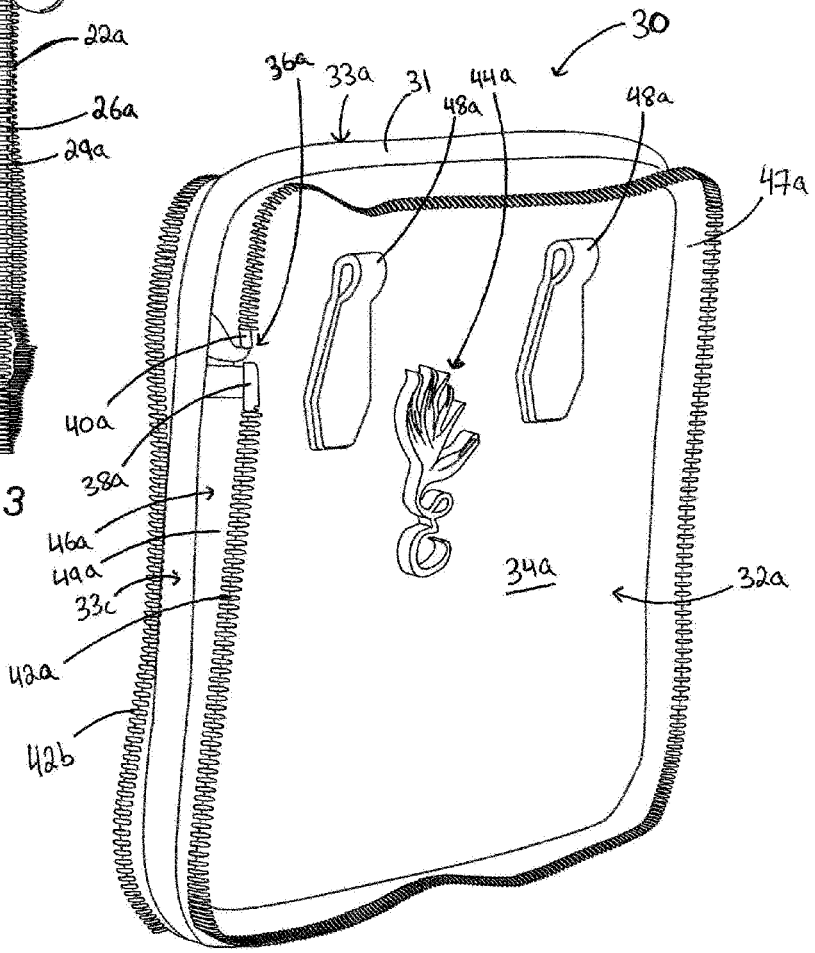
FIG. 4 is an isometric view of a front side panel, constructed and operative according to an embodiment of the present invention, showing a first side of the front side panel.
Figure 5:
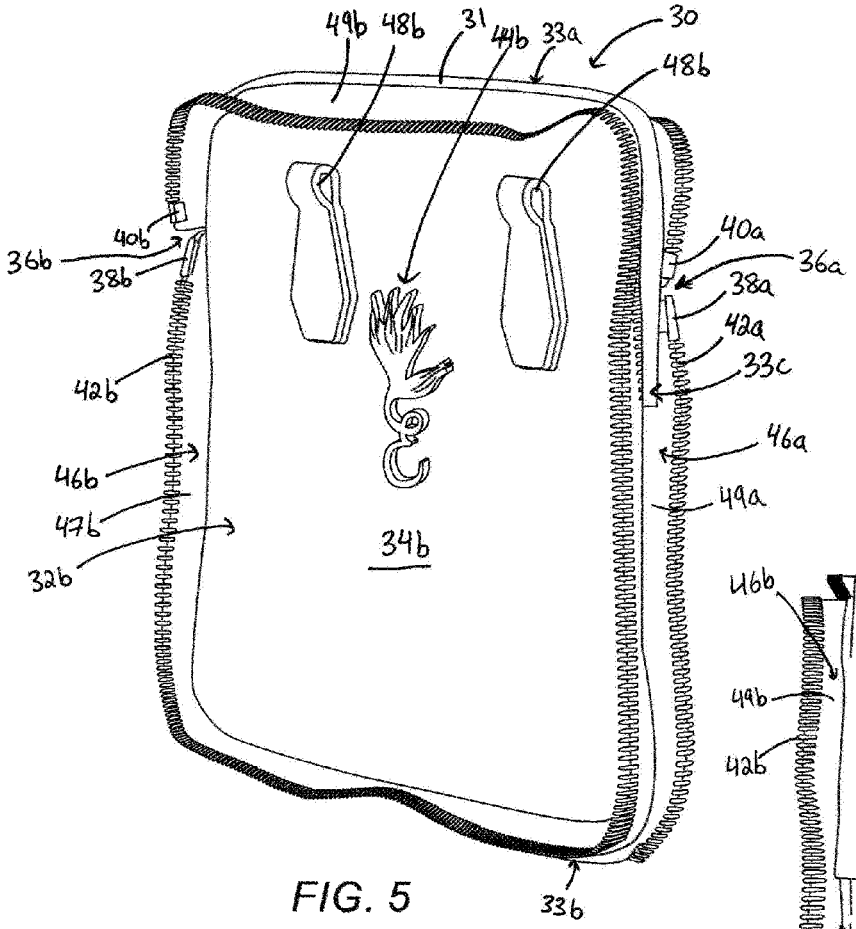
FIG. 5 is an isometric view of the front side panel of FIG. 4, showing a second side of the front side panel.
Figure 6:
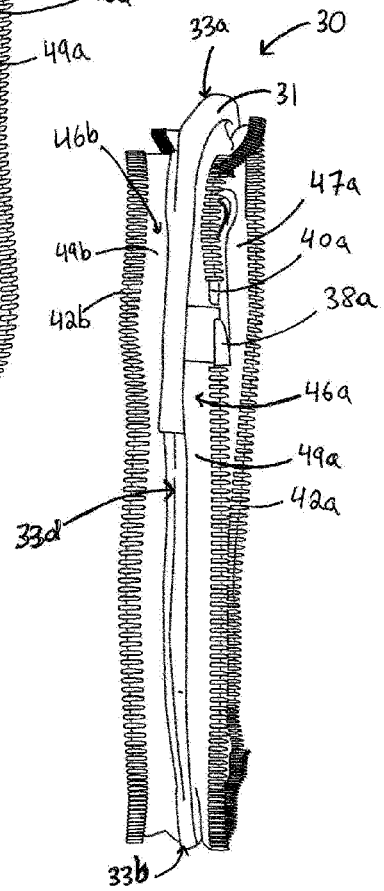
FIG. 6 is a side view of the front side panel of FIGS. 4 and 5.

With continued reference to FIGS. 1-3, refer now to FIGS. 4-6, various views of the front side panel 30 according to an embodiment of the present disclosure. The front side panel 30 is generally similar to the rear side panel 10, with the exception of the zipper arrangements deployed on the front side panel 30, the design markings present on the front side panel 30, and the number of strap connections deployed on the front side panel 30. With continued reference to FIGS. 4-6, the front side panel 30 has two opposing sides, namely a first side 32*a* and a second side 32*b*. According to certain embodiments, the sides 32*a*, 32*b* are integrally formed such that the front side panel 30 is a single member. A first outer sidewall 34*a* is disposed on the first side 32*a*, and a second outer sidewall 34*b* is disposed on the second side 32*b*. The two sides 32*a*, 32*b* may be constructed from the same fabric/material and have the same color/design, or may be constructed from different fabrics/materials and/or have different colors/designs. The outer sidewalls 34*a*, 34*b* are oppositely disposed from each other, and are generally identical to each other. A central flange 31 extends along the entire perimeter of the front side panel 30 and bisects the front side panel 30 along a central plane to separate the front side panel 30 into the two sides 32*a*, 32*b*. The perimeter of the front side panel 30 is defined by a plurality of edges, which in the non-limiting exemplary illustration of the front side panel 30 shown in FIGS. 4-6 includes four such edges, namely a top edge 33*a*, a bottom edge 33*b*, a left edge 33*c*, and a right edge 33*d*. The outer sidewalls 34*a*, 34*b* may be of any geometric shape and correspond to the shape of the rear side panel 10. In the non-limiting exemplary illustration of the front side panel 30 shown in FIGS. 4-6, the outer sidewalls 34*a*, 34*b* are generally square-shaped.

With particular reference to FIG. 4, the first side 32*a* includes a plurality of strap connectors 48*a* attached to the first outer sidewall 34*a*. In the non-limiting exemplary illustration of the front side panel 30 in FIG. 4, there are two such strap connectors 48*a* deployed near the top edge of the front side panel 30. Each of the strap connectors 48*a* is configured to receive a detachable strap to allow carrying of the handbag assembly on a shoulder, as will be discussed in further detail in subsequent sections of the present disclosure.

A design marking 44*a* is also presented on the first outer sidewall 34*a*, for example via embroidery, hot stamping or stitching, and is preferably centralized between the strap connectors 48*a*. The design marking 44*a* may be presented in the form of a brand name or a logo. In certain embodiments, a similar design marking may be presented on the one or both of the outer sidewalls 14*a*, 14*b* of the rear side panel 10.

The first side 32*a* includes a peripheral flange 46*a* having an inner surface 47*a* and an outer surface 49*a*. The peripheral flange 46*a* extends along almost the entire periphery of the first outer sidewall 34*a*, except for a small gap. The peripheral flange 46*a* is attached to the first outer sidewall 34*a* at the central flange 31. The peripheral flange 46*a* is preferably constructed from the same material as the peripheral flanges 26*a*, 26*b*, and therefore preferably has similar flexible properties. As such, the peripheral flange 46*a* can be folded in a first fold configuration so as to bring portions of the inner surface 47*a* into contact with the first outer sidewall 34*a*, and further folded in a second fold configuration whereby the peripheral flange 46*a* is folded over the central flange 31 such that portions of the outer surface 49*a* are folded toward the central flange 31 and onto the edges 33*a-d*.

A first zipper arrangement of a second profile, designated 36*a*, and referred to hereinafter as the zipper arrangement 36*a*, is attached to the peripheral flange 46*a*. The zipper arrangement 36*a* includes a plurality of teeth 42*a* arranged to form a zipper track in a nearly closed loop, where the beginning and end of the nearly closed loop are marked by two respective ends of the zipper track. The teeth 42*a* are attached to a terminating portion of the peripheral flange 46*a*. The attachment of the teeth 42*a* to the peripheral flange 46*a* is made, for example, via sewing or stitching, or via adhesive bonding techniques. When the peripheral flange 46*a* is folded in the first fold configuration, the teeth 42*a* are brought towards the first outer sidewall 34*a*, and when the peripheral flange 46*a* is folded in the second fold configuration, the teeth are brought towards the central flange 31. An insertion pin 38*a* is deployed at the first end of the zipper track, and an end post 40*a* is deployed at the second end of the zipper track. The end post 40*a* is preferably positioned near the intersection of two of the edges of the front side panel 30, slightly offset from one of the two edges. In the non-limiting exemplary illustration of the front side panel 30 shown in FIGS. 4-6, the end post 40*a* is positioned along the left edge 33*c* and a few centimeters (e.g., 3 centimeters) below the top edge 33*a*.

The zipper arrangement 36*a* and the zipper arrangements 16*a*, 16*b* are correspondingly configured with respect to the positioning of the end posts 20*a*, 20*b*, 40*a* and the positioning of the insertion pin 38*a* and the retainer boxes 18*a*, 18*b*.

The peripheral flange 46*a* forms nearly a closed loop, such that the two ends of the zipper arrangement 36*a* (i.e., the insertion pin 38*a* and the end post 40*a*) are in close proximity to each other. The insertion pin 38*a* and the retainer boxes 18*a*, 18*b* are correspondingly configured, such that the insertion pin 38*a* can be inserted into either of the retainer boxes 18*a*, 18*b*. Furthermore, the teeth 42*a* are configured to engage with either of the teeth 22*a*, 22*b*, depending on which side of the rear side panel 10 is to be attached to the front side panel 30.

With continued reference to FIG. 4, refer now to FIG. 5, the second side 32*b* of the front side panel 30. The second side 32*b* includes a plurality of strap connectors 48*b* attached to the second outer sidewall 34*b*. Preferably, the first and second sides 32*a*, 32*b* have the same number of strap connectors 48*a*, 48*b*. A design marking 44*b* is also presented on the second outer sidewall 34*b*, for example via embroidery, hot stamping or stitching, and is preferably centralized between the strap connectors 48*b*. The design marking 44*b* may be the same as the design marking 44*a*. In certain embodiments, the design markings 44*a*, 44*b* may have different features, including, but not limited to, material from which the design markings 44*a*, 44*b* are constructed, design patterns, colors, and the like.

The second side 32*b* includes a peripheral flange 46*b* having an inner surface 47*b* and an outer surface 49*b*. The peripheral flange 46*b* extends along almost the entire periphery of the second outer sidewall 34*b*, except for a small gap. The peripheral flange 46*b* is attached to the first outer sidewall 34*b* at the central flange 31. The peripheral flange 46*b* is preferably constructed from the same material has the peripheral flanges 26*a*, 26*b*, 46*a*, and therefore preferably has similar flexible properties. As such, the peripheral flange 46*b* can be folded in a first fold configuration so as to bring portions of the inner surface 47*b* into contact with the second outer sidewall 34*b*, and further folded in a second fold configuration whereby the peripheral flange 46*b* is folded over the central flange 31 such that portions of the outer surface 49*b* are folded toward the central flange 31, onto the edges 33*a-d*.

A second zipper arrangement of the second profile, designated 36*b*, and referred to hereinafter as the zipper arrangement 36*b*, is attached to the peripheral flange 46*a*. The zipper arrangement 36*b* includes a plurality of teeth 42*b* arranged to form a zipper track in a nearly closed loop, where the beginning and end of the nearly closed loop are marked by two respective ends of the zipper track. The teeth 42*b* are attached to a terminating portion of the peripheral flange 46*b*. The attachment of the teeth 42*b* to the peripheral flange 46*b* is made, for example, via sewing or stitching, or via adhesive bonding techniques. When the peripheral flange 46*b* is folded in the first fold configuration, the teeth 42*b* are brought towards the second outer sidewall 34*b*, and when the peripheral flange 46*b* is folded in the second fold configuration, the teeth are brought towards the central flange 31. An insertion pin 38*b* is deployed at the first end of the zipper track, and an end post 40*b* is deployed at the second end of the zipper track. The end post 40*b* is preferably positioned near the intersection of two of the edges of the front side panel 30, slightly offset from one of the two edges. In the non-limiting exemplary illustration of the front side panel 30 shown in FIGS. 4-6, the end post 40*b* is positioned along the right edge 33*d* and a few centimeters (e.g., 3 centimeters) below the top edge 33*a*.

The zipper arrangement 36*b* and the zipper arrangements 16*a*, 16*b* are correspondingly configured with respect to the positioning of the end posts 20*a*, 20*b*, 40*b* and the positioning of the insertion pin 38*b* and the retainer boxes 18*a*, 18*b*.

The peripheral flange 46*b* forms nearly a closed loop, such that the two ends of the zipper arrangement 36*b* (i.e., the insertion pin 38*b* and the end post 40*b*) are in close proximity to each other. The insertion pin 38*b* and the retainer boxes 18*a*, 18*b* are correspondingly configured, such that the insertion pin 38*b* can be inserted into either of the retainer boxes 18*a*, 18*b*. Furthermore, the teeth 42*b* are configured to engage with either of the teeth 22*a*, 22*b*, depending on which side of the rear side panel 10 is to be attached to the front side panel 30.

Similar to the inverse orientation between the zipper arrangements 16*a*, 16*b*, it is a particular feature of the handbag assembly of the present disclosure that the zipper arrangements 36*a*, 36*b* be inversely oriented relative to each other. The inverse orientation of the zipper arrangements 36*a*, 36*b* is most clearly observable in FIG. 5. The inverse orientation allows the front side panel 30 to be reversibly attached to the rear side panel 10. Within the context of the present disclosure, the inverse orientation of the zipper arrangements 36*a*, 36*b* generally refers to the configuration in which the insertion pin 38*a* and the end post 40*a* are deployed proximate to one edge of the front side panel 30, and the insertion pin 38*b* and the end post 40*b* are deployed proximate to a different edge of the front side panel 30. In geometries in which the outer sidewalls 34*a*, 34*b* are square-shaped, the different edges are opposite edges. In the non-limiting exemplary illustration of the front side panel 30 shown in FIGS. 4-6, the insertion pin 38*a* and the end post 40*a* are deployed at or near the upper portion of the right edge 33*c*, and the insertion pin 38*b* and the end post 40*b* are deployed at or near the upper portion of the left edge 33*d*.

The following paragraphs describe the connection operation between the side panels 10, 30 via engagement of pairs of the zipper arrangements 16*a*, 16*b*, 36*a*, 36*b* to form a zipper fastening arrangement. When the two side panels 10, 30 are connected to each other, the connection pair forms a handbag having a storage space formed by one of the outer sidewalls 14*a*, 14*b* and one of the outer sidewalls 34*a*, 34*b*. The storage space, also referred to interchangeably a compartment or storage compartment, is further formed by one of the outer surfaces 29*a*, 29*b* and one of the outer surfaces 49*a*, 49*b*, which fold towards each other as the pair of zipper arrangements engage with each other. With continued reference to FIGS. 1-6, refer now to FIGS. 7A-9, a non-limiting attachment of the two side panels 10, 30. The side panel connection illustrated in FIGS. 7A-9 represents a first configuration in which the storage space is formed by the second outer sidewalls 14*b*, 34*b*, the outer surface 29*a* of the peripheral flange 26*a* of the first side 12*a* of the rear side panel 10, and the outer surface 49*a* of the peripheral flange 46*a* of the first side 32*a* of the front side panel 30.

Figure 7A:
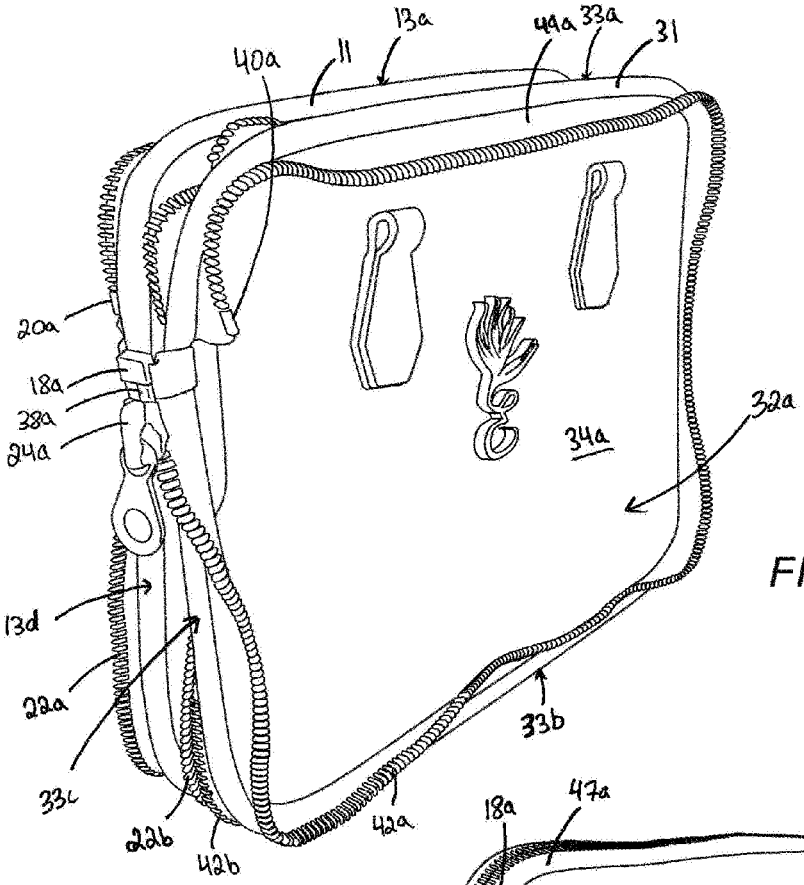
FIGS. 7A and 7B are isometric views of a handbag assembly, formed from the rear side panel and the front side panel, showing the first side of the front side panel, the handbag assembly being shown in a zipper initial engaged state and a zipper closed state, respectively.
Figure 7B:
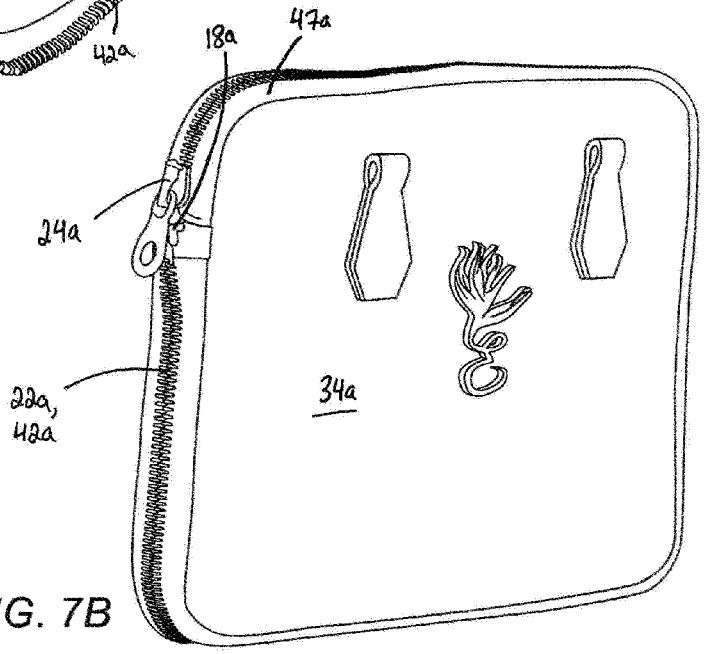
Figure 8A:
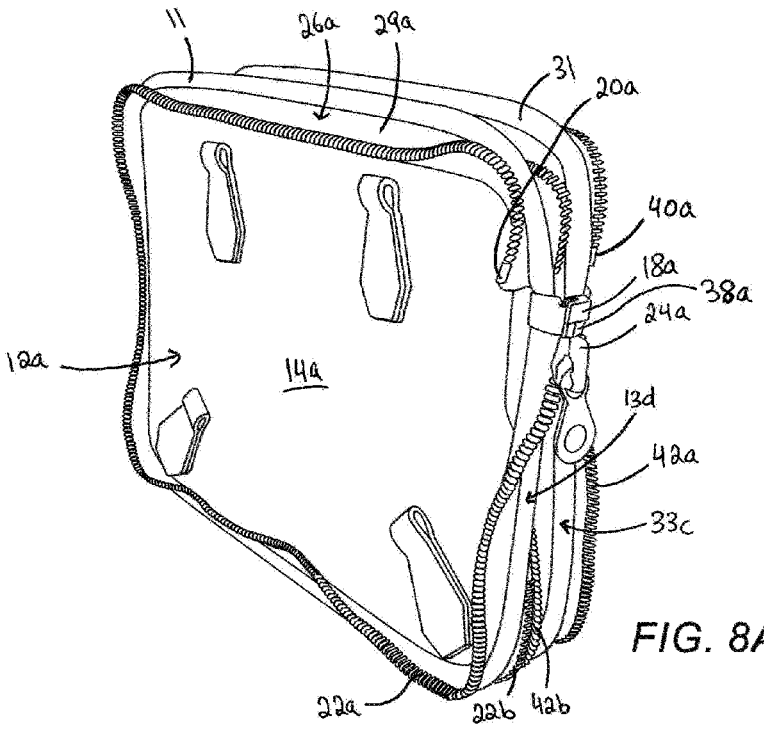
FIGS. 8A and 8B are isometric views of the handbag assembly of FIGS. 7A and 7B, showing the first side of the rear side panel.
Figure 8B:
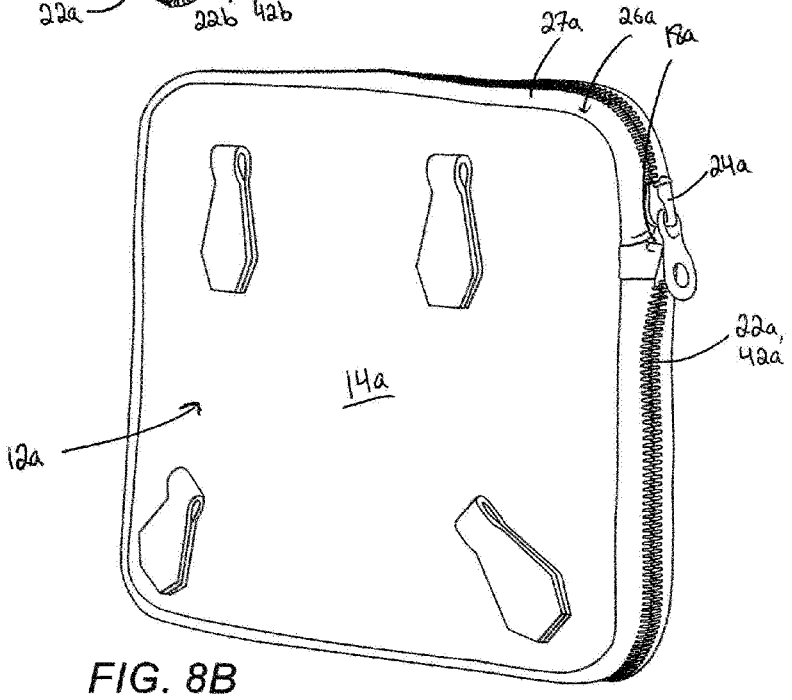
Figure 9:
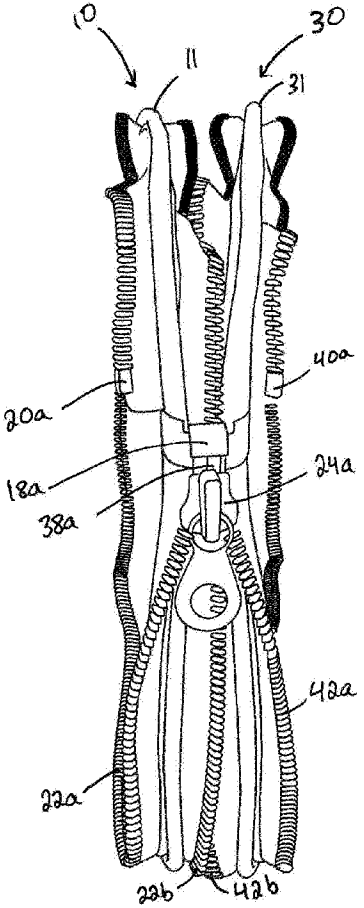
FIG. 9 is a side view of the handbag assembly of FIGS. 7A-8B.

FIGS. 7A, 8A and 9 illustrate a zipper initial engaged state, in which the insertion pin 38*a* of the zipper arrangement 36*a* of the first side 32*a* of the front side panel 30 is inserted into the retainer box 18*a* of the zipper arrangement 16*a* of the first side 12*a* of the rear side panel 10. The coupling of the insertion pin 38*a* and the retainer box 18*a* causes the portion of the outer surface 49*a* of the peripheral flange 46*a* near the insertion pin 38*a* to fold toward the central flange 31, and similarly causes the portion of the outer surface 49*a* of the peripheral flange 46*a* near the retainer box 18*a* to fold toward the central flange 11. The connection between the two side panels 10, 30 is formed by moving the slider 24*a* along the edges of the side panels 10, 30 in either a clockwise or counter clockwise direction, depending on the orientation of the retainer box 18*a* and the end post 20*a*. In the non-limiting representation of the first configuration shown in FIGS. 7A-9, the slider 24*a* moves along the aforementioned edges in the clockwise direction (when taken from the perspective looking at the rear side panel 10 as in FIG. 8A).

As the slider 24*a* continuously traverses along the edges of the side panels 10, 30, the slider 24*a* moves along the teeth 22*a*, 42*a*, causing the zipper arrangements 16*a*, 36*a* to engage with each other via interlocking of the teeth 22*a*, 42*a* to form a zipper fastening arrangement. In the depiction illustrated in FIGS. 7A-9, the slider 24*a* first moves along the right edges 13*c*, 33*c*, then moves along the bottom edges 13*b*, 33*b*, then moves along the left edges 13*d*, 33*d*, and finally moves along the top edges 13*a*, 33*a*, until stopping at the end posts 20*a*, 40*a*. The movement of the slider 24*a* from the retainer box 18*a* and the insertion pin 38*a* toward the end posts 20*a*, 40*a* causes portions of the outer surfaces 29*a*, 49*a* of the peripheral flanges 26*a*, 46*a* to fold toward the respective central flanges 11, 31, resulting in a twisting action of the peripheral flanges 26*a*, 46*a* as the slider 24*a* progresses along the zipper track formed by the teeth 22*a*, 42*a*.

FIGS. 7B and 8B show the handbag assembly in a zipper closed state after completion of the side panel connection. Moving the slider 24*a* in the reverse direction along the top edges 13*a*, 33*a* (i.e., away from the end posts 20*a*, 40*a*) opens the handbag to allow access to the storage space formed by the second outer sidewalls 14*b*, 34*b*. The resulting handbag, when constructed from smaller sized side panels, forms a clutch type purse. Typically, clutch type purses are intended to be hand-held by the user. However, the strap connectors 28*a*, 48*a* provide mechanisms for attaching shoulder or back-straps, to allow the user to wear the handbag over one or both shoulders. Note that the handbag of FIGS. 1-9 may be formed from larger sized side panels, resulting in larger sized handbags than those typically attributed to clutches.

As mentioned above, the side panel connection illustrated in FIGS. 7A-9 represents a first configuration. At least three other similar configurations are possible. In a second configuration, the front side panel 30 is reversed (relative to the orientation in the first configuration) such that the storage space is formed by the second outer sidewall 14*b* of the rear side panel 10, the first outer sidewall 34*a* of the front side panel 30, the outer surface 29*a* of the peripheral flange 26*a* of the first side 12*a* of the rear side panel 10, and the outer surface 49*b* of the peripheral flange 46*b* of the second side 32*b* of the front side panel 30. In such a configuration, the insertion pin 38*b* of the zipper arrangement 36*b* of the second side 32*b* of the front side panel 30 is inserted into the retainer box 18*a* of the zipper arrangement 16*a* of the first side 12*a* of the rear side panel 10. As the slider 24*a* continuously traverses along the edges of the side panels 10, 30, the slider 24*a* moves along the teeth 22*a*, 42*b*, causing the zipper arrangements 16*a*, 36*b* to engage with each other via interlocking of the teeth 22*a*, 42*b*, until stopping at the end posts 20*a*, 40*b*.

In a third configuration, the rear side panel 10 is reversed (relative to the orientation in the first configuration) such that the storage space is formed by the first outer sidewall 14*a* of the rear side panel 10, the second outer sidewall 34*b* of the front side panel 30, the outer surface 29*b* of the peripheral flange 26*b* of the second side 12*b* of the rear side panel 10, and the outer surface 49*a* of the peripheral flange 46*a* of the first side 32*a* of the front side panel 30. In such a configuration, the insertion pin 38*a* of the zipper arrangement 36*a* of the first side 32*a* of the front side panel 30 is inserted into the retainer box 18*b* of the zipper arrangement 16*b* of the second side 12*b* of the rear side panel 10. As the slider 24*b* continuously traverses along the edges of the side panels 10, 30, the slider 24*b* moves along the teeth 22*b*, 42*a*, causing the zipper arrangements 16*b*, 36*a* to engage with each other via interlocking of the teeth 22*b*, 42*a*, until stopping at the end posts 20*b*, 40*a*.

In a fourth configuration, both of the side panels 10, 30 are reversed (relative to the orientation in the first configuration) such that the storage space is formed by the first outer sidewalls 14*a*, 34*a*, the outer surface 29*b* of the peripheral flange 26*b* of the second side 12*b* of the rear side panel 10, and the outer surface 49*b* of the peripheral flange 46*b* of the second side 32*b* of the front side panel 30. In such a configuration, the insertion pin 38*b* of the zipper arrangement 36*b* of the second side 32*b* of the front side panel 30 is inserted into the retainer box 18*b* of the zipper arrangement 16*b* of the second side 12*b* of the rear side panel 10. As the slider 24*b* continuously traverses along the edges of the side panels 10, 30, the slider 24*b* moves along the teeth 22*b*, 42*b*, causing the zipper arrangements 16*b*, 36*b* to engage with each other via interlocking of the teeth 22*b*, 42*b*, until stopping at the end posts 20*b*, 40*b*.

Note that additional storage spaces may be provided on one or more of the outer sidewalls 14*a*, 14*b*, 34*a*, 34*b* via zipper fastening arrangements, sleeves, pouches, pockets, and the like.

Although embodiments of the present disclosure as described thus far have pertained to two side panels 10, 30 in which the two sides of each side panel are integrally formed such that each side panel is formed as a single member, other embodiments are possible in which the two sides of either or both of the side panels are removably attachable to each other. In such embodiments, the first side 12*a* may be removably attachable to the second side 12*b* via an attachment mechanism. The attachment mechanism attaches the two sides 12*a*, 12*b* to each other at an opposing sidewall of the first side 12*a* oppositely disposed form the first outer sidewall 14*a* and an opposing sidewall of the second side 12*b* oppositely disposed form the second outer sidewall 14*b*. The attachment mechanism may be implemented in a variety of ways, such as, for example, snap fasteners (i.e., male and female snap members), magnetic pair fasteners, and hook and loop fasteners. For example, one or more male snap members may be deployed on the opposing sidewall of the first outer sidewall 14*a* and one or more correspondingly configured female snap members may be deployed on the opposing sidewall of the second outer sidewall 14*b*.

Although embodiments of the present disclosure as described thus far have pertained to two side panels 10, 30 directly connecting with each other via respective zipper arrangements 16*a*, 16*b*, 36*a*, 36*b*, other embodiments are possible in which at least one of the side panels is connected to an additional handbag component to form a larger handbag. With continued reference to FIGS. 1-9, refer now to FIGS. 10-14B, various views of components of a handbag assembly according to a further embodiment of the present disclosure.

Figure 10:
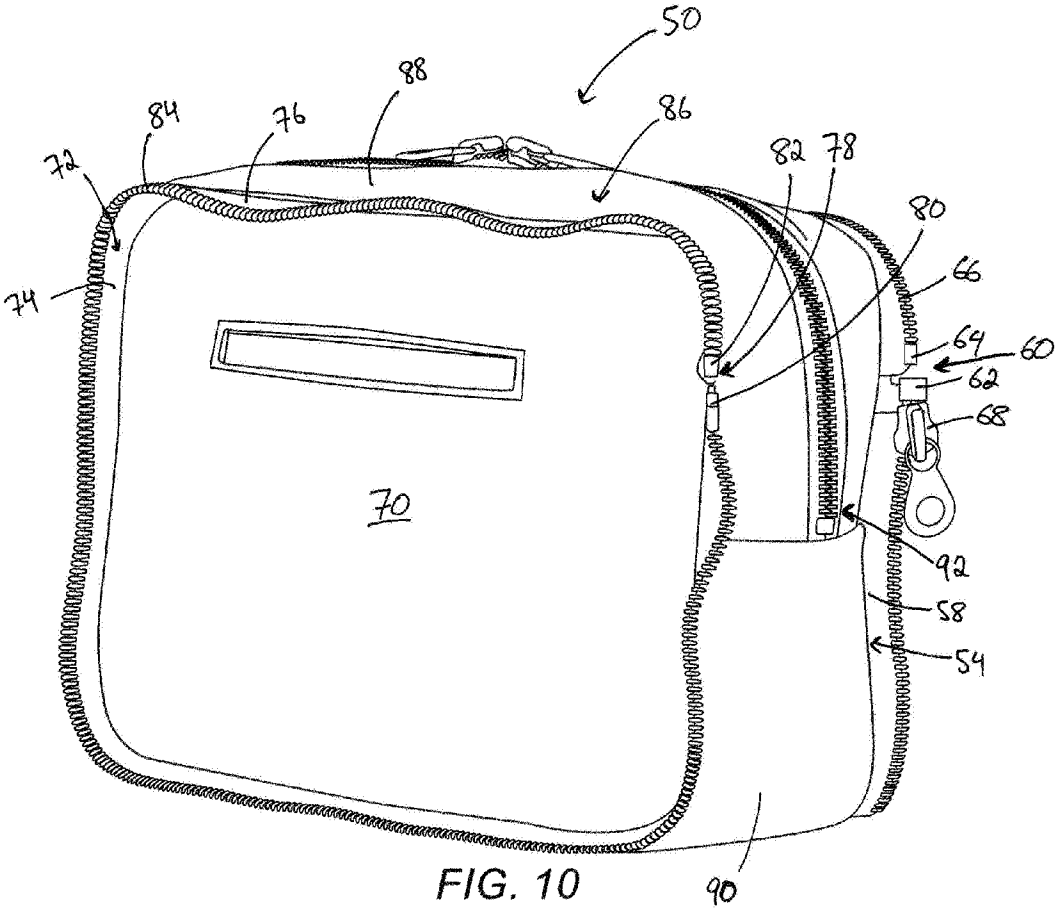
FIGS. 10 and 11 are isometric views of a central member, constructed and operative according to an embodiment of the present invention.
Figure 12:
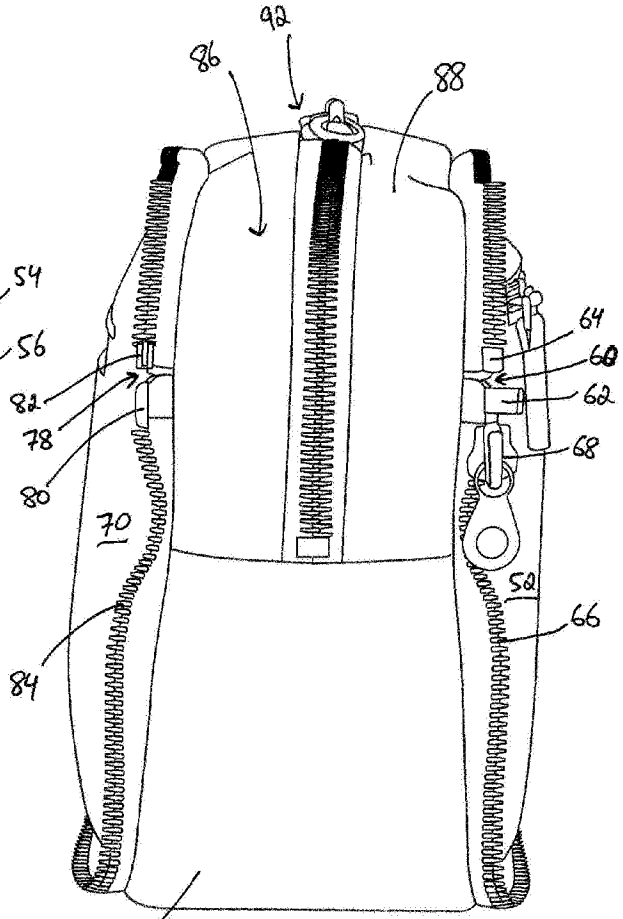
FIG. 12 is a side view of the central member of FIGS. 10 and 11.
Figure 11:
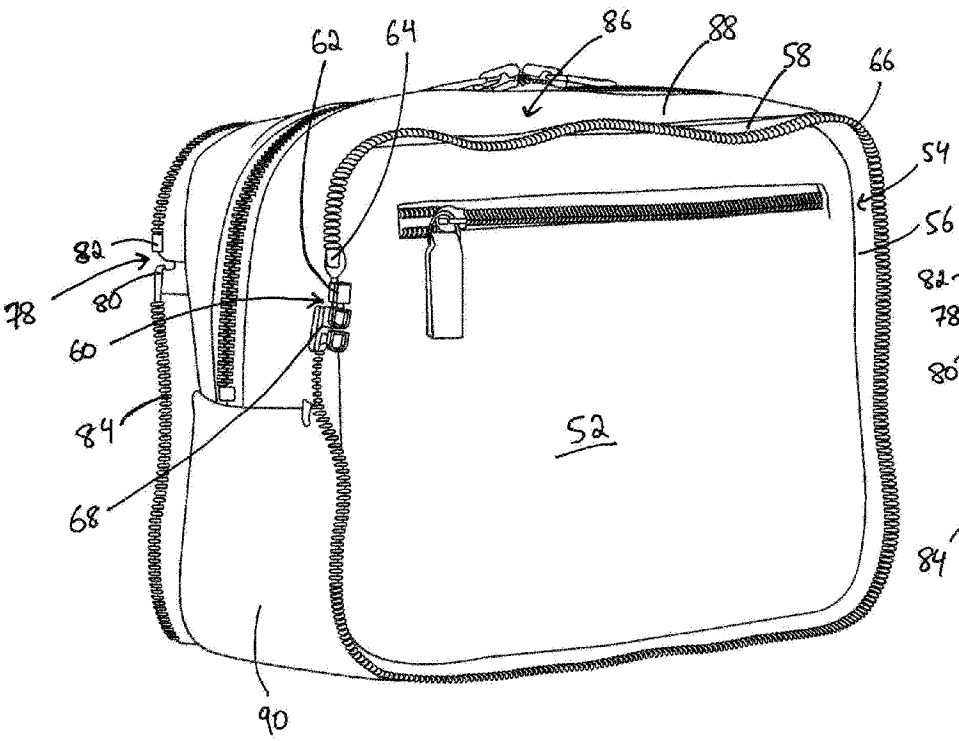
Figure 13A:
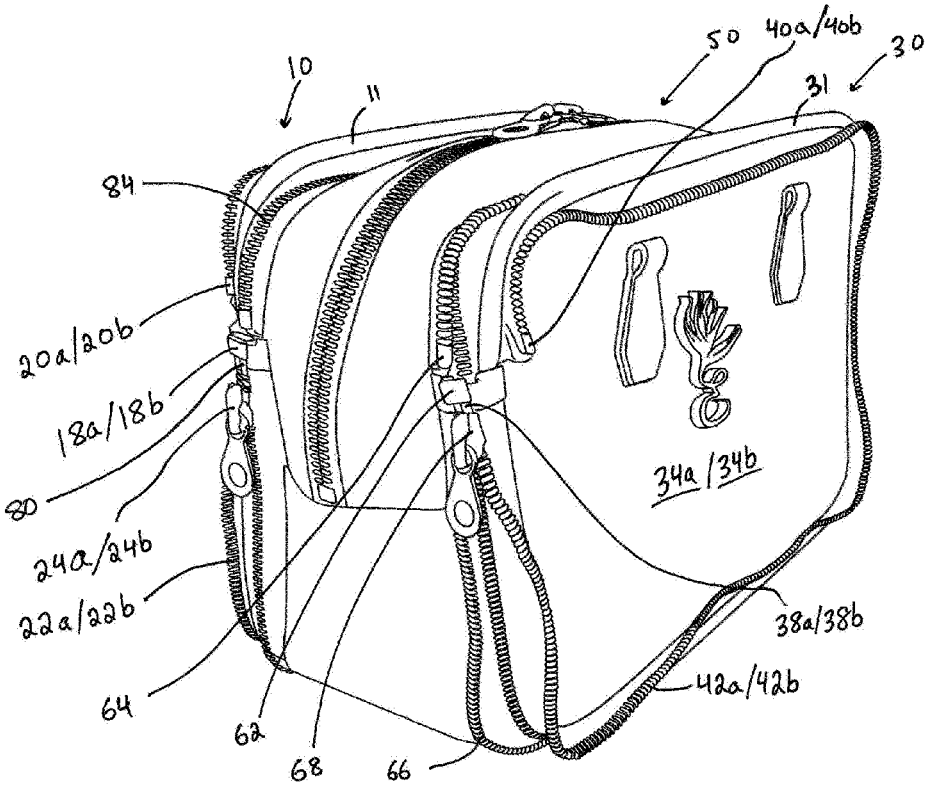
FIGS. 13A and 13B are isometric views of a handbag assembly, formed from the rear side panel, the front side panel, and the central member, the handbag assembly being shown in a zipper initial engaged state and a zipper closed state, respectively.
Figure 13B:
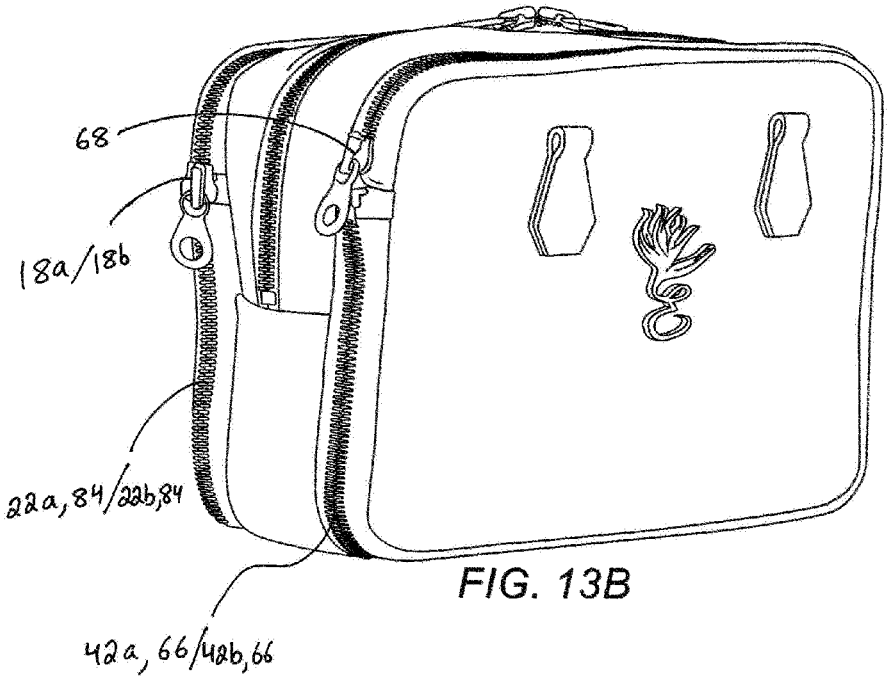
Figure 14A:
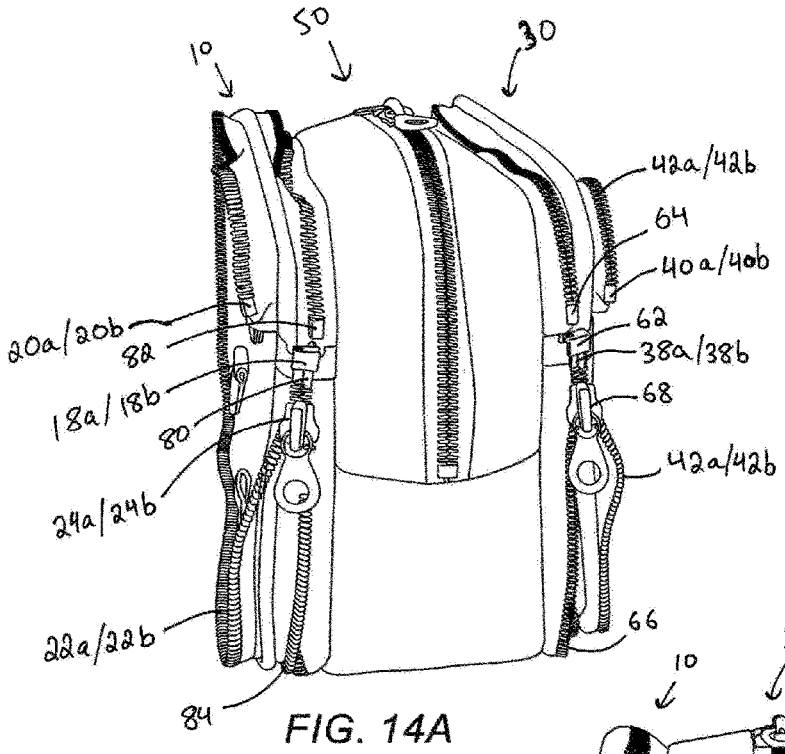
FIGS. 14A and 14B are side views of the handbag assembly of FIGS. 13A and 13B, respectively.
Figure 14B:
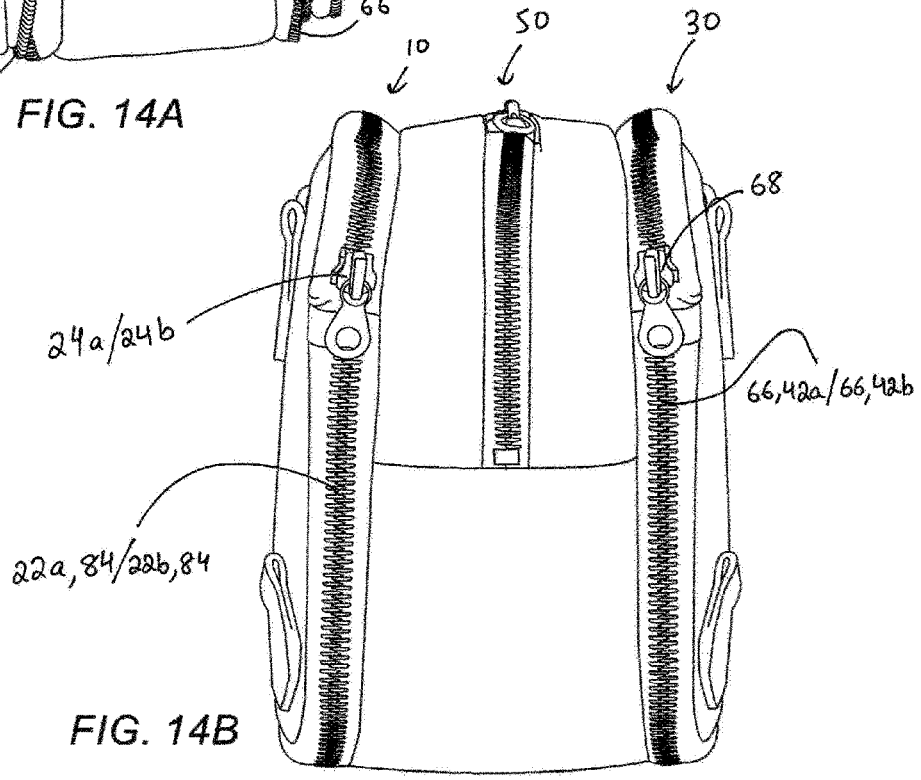
Figure 15:
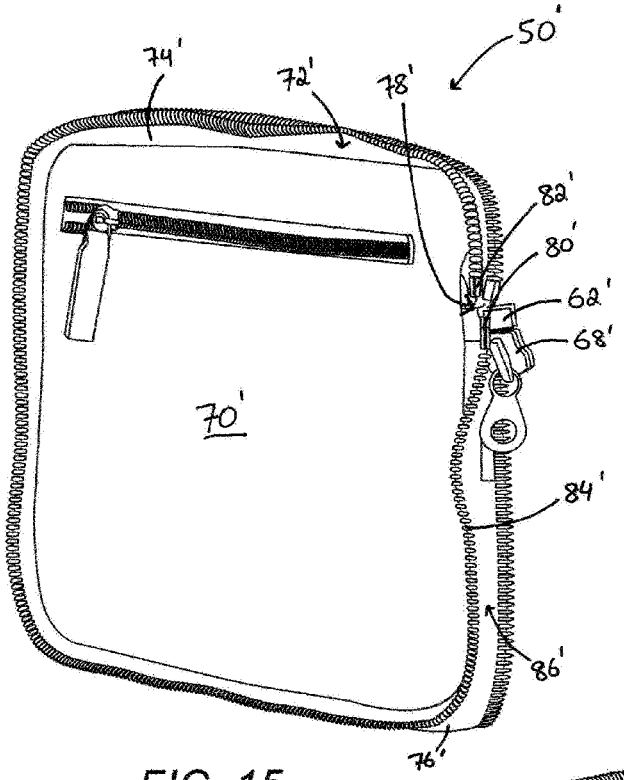
FIGS. 15 and 16 are isometric views of a central member, constructed and operative according to another embodiment of the present invention.
Figure 16:
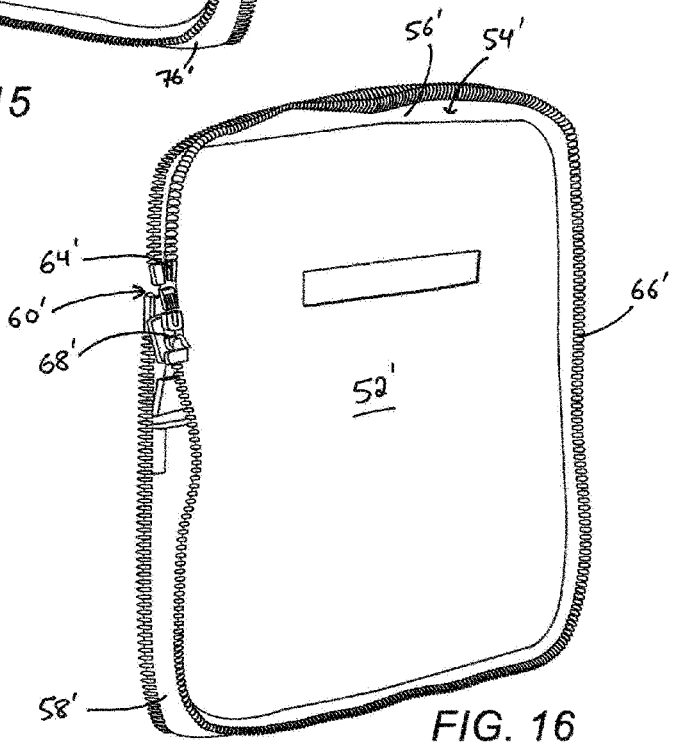

With particular reference to FIGS. 10-12, a central member 50 includes a plurality of sidewalls, including a first outer sidewall 52, a second outer sidewall 70 oppositely disposed from the first outer sidewall 52, and a peripheral sidewall 86 extending between the two outer sidewalls 52, 70. The peripheral sidewall 86 has an upper portion 88 formed at or near the top of the peripheral sidewall 86 and constituting the upper half portion of the peripheral sidewall 86, and has a lower portion 90 formed at or near the bottom of the peripheral sidewall 86 constituting the lower half portion of the peripheral sidewall 86. The upper portion 88 includes a zipper arrangement 92, including a plurality of corresponding sets of zipper teeth, which provides access to a storage space defined by a plurality of inner sidewalls of the central member 50. Specifically, although not shown in the drawings, the first outer sidewall 52 has a corresponding oppositely disposed first inner sidewall, the second outer sidewall 70 has a corresponding oppositely disposed second inner sidewall, and the lower portion 90 of the peripheral sidewall 86 has a corresponding oppositely disposed third inner sidewall. The storage space of the central member 50 is defined in part by each of the three inner sidewalls. The peripheral sidewall 86 preferably has a width of at least three centimeters to provide adequate storage volume in the storage space.

The central member 50 includes a first peripheral flange 54 having an inner surface 56 and an outer surface 58. The peripheral flange 54 extends along almost the entire periphery of the first outer sidewall 52, except for a small gap. The peripheral flange 54 is attached to the central member 50 at the planar intersection between the first outer sidewall 52 and the peripheral sidewall 86. The peripheral flange 54 may be constructed from a material having a degree of flexure, similar to the peripheral flanges 26*a*, 26*b*, 46*a*, 46*b*. However, in preferred embodiments, the peripheral flange 54 is static and does not fold as with the peripheral flanges 26*a*, 26*b*, 46*a*, 46*b*.

A third zipper arrangement of the first profile, designated 60, and referred to hereinafter as the zipper arrangement 60, is attached to the peripheral flange 54. The zipper arrangement 60 includes a plurality of teeth 66 arranged to form a zipper track in a nearly closed loop, where the beginning and end of the nearly closed loop are marked by two respective ends of the zipper track. The zipper arrangement 60 is attached to a terminating portion of the peripheral flange 54. The attachment of the zipper arrangement 60 to the peripheral flange 54 is made, for example, via sewing or stitching, or via adhesive bonding techniques. A retainer box 62 is deployed at the first end of the zipper track, and an end post 64 is deployed at the second end of the zipper track. The end post 64 is preferably positioned near the intersection of two edges of the central member 50, slightly offset from one of the two edges. In the non-limiting exemplary illustration of the central member 50 shown in FIGS. 10-12, the end post 64 is positioned along the left edge of the central member 50 and a few centimeters (e.g., 3 centimeters) below the top edge of the central member 50.

The central member 50 includes a second peripheral flange 72 having an inner surface 74 and an outer surface 76. The peripheral flange 72 extends along almost the entire periphery of the second outer sidewall 70, except for a small gap. The peripheral flange 72 is attached to the central member 50 at the planar intersection between the second outer sidewall 70 and the peripheral sidewall 86. The peripheral flange 72 may be constructed from a material having a degree of flexure, similar to the peripheral flanges 26*a*, 26*b*, 46*a*, 46*b*, 54. However, in preferred embodiments, the peripheral flange 54 is static and does not fold as with the peripheral flanges 26*a*, 26*b*, 46*a*, 46*b*.

A third zipper arrangement of the second profile, designated 78, and referred to hereinafter as the zipper arrangement 78, is attached to the peripheral flange 70. The zipper arrangement 78 includes a plurality of teeth 84 arranged to form a zipper track in a nearly closed loop, where the beginning and end of the nearly closed loop are marked by two respective ends of the zipper track. The zipper arrangement 78 is attached to a terminating portion of the peripheral flange 72. The attachment of the zipper arrangement 78 to the peripheral flange 72 is made, for example, via sewing or stitching, or via adhesive bonding techniques. An insertion pin 80 is deployed at the first end of the zipper track, and an end post 82 is deployed at the second end of the zipper track. The end post 82 is preferably positioned near the intersection of two edges of the central member 50, slightly offset from one of the two edges. In the non-limiting exemplary illustration of the central member 50 shown in FIGS. 10-12, the end post 82 is positioned along the right edge of the central member 50 and a few centimeters (e.g., 3 centimeters) below the top edge of the central member 50.

Referring now to FIGS. 13A-14B, attachment of the rear side panel 10 and the front side panel 30 to the central member 50. The front side panel 30 is configured to attach to the central member via engagement of the zipper arrangement 60 with one of the zipper arrangements 36*a*, 36*b* to form a zipper fastening arrangement. As such, the zipper arrangement 60 and the zipper arrangements 36*a*, 36*b* are correspondingly configured with respect to the positioning of the end posts 40*a*, 40*b*, 64 and the positioning of the insertion pins 38*a*, 38*b* and the retainer box 62. Similarly, the rear side panel 10 is configured to attach to the central member 50 via engagement of the zipper arrangement 78 with one of the zipper arrangements 16*a*, 16*b* to form a zipper fastening arrangement. As such, the zipper arrangement 78 and the zipper arrangements 16*a*, 16*b* are correspondingly configured with respect to the positioning of the end posts 20*a*, 20*b*, 82 and the positioning of the retainer boxes 18*a*, 18*b* and the insertion pin 80.

The engagement of the zipper arrangement 60 with one of the zipper arrangements 36*a*, 36*b*, and the engagement of the zipper arrangement 78 with one of the zipper arrangements 16*a*, 16*b*, are similar to as described above with reference to FIGS. 7A-9 and will be understood by analogy thereto. As a result of the engagement, one or both of the side panels 10, 30 can be attached to the central member 50 with either of the sides 12*a*, 12*b*, 32*a*, 32*b* exposed. As such, in addition to the storage space of the central member 50 defined in part by each of the three inner sidewalls, as described above, two additional storage spaces are provided by the attachment of the side panels 10, 30 to the central member 50. A first additional storage space is defined in part by the first outer sidewall 52 and one of the outer sidewalls 34*a*, 34*b* of the front side panel 30, and a second additional storage space is defined in part by the second outer sidewall 70 and one of the outer sidewalls 14*a*, 14*b* of the rear side panel 10.

As shown in FIGS. 10-12, the central member 50 may include further storage spaces on one or more of the outer sidewalls 52, 70 via zipper fastening arrangements. Note that although the central member 50, as shown in FIGS. 10-14B, has a generally square or rectangular shaped cross-section when taken in the plane perpendicular to the outer sidewalls 52, 70 and parallel to the lower portion 90, other cross-sectional shapes are contemplated, including, for example, triangular cross-sections, wherein the width of the central member 50 narrows when moving from the lower portion 90 to the zipper arrangement 92. Such triangular shaped cross-sections may provide greater flexibility of the central member 50, allowing easier access to the storage space of the central member 50.

In certain embodiments, the central member 50 includes one or more removable linings removably attachable to the inner sidewalls of the central member 50. The removable lining may include compartments that can be opened and closed, and made accessible via, for example, zipper arrangements, hook and loop fasteners, snap mechanisms (e.g., male and female snap members), magnetic pair fasteners, and the like. The lining may also include open compartments, such as, for example, pouches, sleeves, and the like, for storing makeup, pens, pencils, calculators, glasses, money, wallets, beverage bottles, and other items typically stored in purses and handbags. In certain embodiments, the lining includes one or more detachable elastic straps attached to the lining at one end and having a key loop fastener at an opposing end for removably attaching a key ring or set of keys thereto. In alternative embodiments, the elastic strap is attached directly to one of the inner sidewalls of the central member 50. The lining may be attached to the inner sidewalls of the central member 50 via a mechanical attachment. In certain embodiments, the mechanical attachment is implemented as a twisting lock arrangement, in which the lining includes one or more slots and the inner sidewalls include one or more rotatable posts that are inserted into the slots in a first orientation and rotated to a second orientation to prevent removal of the lining from the inner sidewalls. In alternative embodiments, the mechanical attachment is implemented as a zipper arrangement, wherein a first part of the zipper arrangement (e.g., zipper teeth and insertion pin) are attached, for example via sewing or stitching, to an upper portion of the inner sidewalls of the central member 50, and wherein a second part of the zipper arrangement (e.g., zipper teeth and retainer box and) are attached to an edge of the lining.

According to certain embodiments, the central member 50 includes one or more pouches on a portion of the peripheral sidewall 86 for storing larger or builder items than would typically be able to fit in the storage space defined by the plurality of inner sidewalls of the central member 50. For example, in certain embodiments, the one or more pouches are dimensioned to retain an umbrella. The pouch may include an expandable and retractable mesh sleeve to allow secure storage and easy removal of the contents of the pouch.

In certain embodiments, the central member 50 is invertible (i.e., can be turned inside out), such that, the central member 50 is usable in a non-inverted configuration and an inverted configuration. The outer sidewalls 52, 70 of the central member 50 in the non-inverted configuration are the inner sidewalls of the central member 50 in the inverted configuration, and the outer sidewalls of the central member in the inverted configuration are inner sidewalls of the central member 50 in the non-inverted configuration.

Although FIGS. 10-14B illustrate embodiments in which a handbag is formed from a single central member 50 and two side panels 10, 30, other embodiments are contemplated in which two or more central members 50 are attached to each other via the zipper engagement methodology described thus far in the present disclosure. For example, a zipper fastening arrangement may be formed by engagement of the zipper arrangement 60 of a first central member with the zipper arrangement 78 of a second central member, thereby forming a double central member handbag. This process can be continued to construct a modular handbag composed of two or more central members. The side panels 10, 30 can then be attached to corresponding outer sidewalls of the respective outermost central members.

FIGS. 15-17B illustrate an alternative embodiment of a central member 50'. The central member 50' includes a first outer sidewall 52', a second outer sidewall 70', and a peripheral sidewall 86' extending between the two outer sidewalls 52', 70'.

A first peripheral flange 54' having an inner surface 56' and an outer surface 58' extends along almost the entire periphery of the first outer sidewall 52', except for a small gap. A zipper arrangement of the first profile, designated 60', and referred to hereinafter as the zipper arrangement 60', is attached to the peripheral flange 54'. The zipper arrangement 60' includes a plurality of teeth 66' arranged to form a zipper track, a retainer box 62 deployed at a first end of the zipper track, and an end post 64' deployed at a second end of the zipper track.

A second peripheral flange 72' having an inner surface 74' and an outer surface 76' extends along almost the entire periphery of the second outer sidewall 70', except for a small gap. A zipper arrangement of the second profile, designated 78', and referred to hereinafter as the zipper arrangement 78', is attached to the peripheral flange 70'. The zipper arrangement 78' includes a plurality of teeth 84' arranged to form a zipper track, an insertion pin 80' deployed at a first end of the zipper track, and an end post 82' deployed at a second end of the zipper track.

Figure 17A:
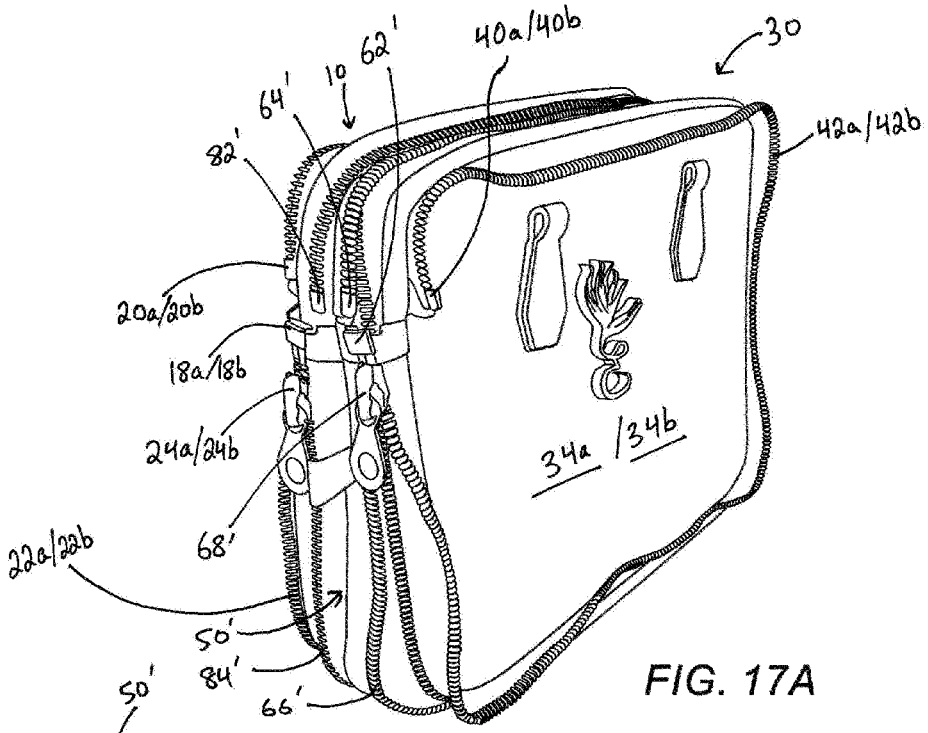
FIGS. 17A and 17B are isometric views of a handbag assembly, formed from the rear side panel, the front side panel, and the central member of FIGS. 15 and 16, the handbag assembly being shown in a zipper initial engaged state and a zipper closed state, respectively.
Figure 17B:
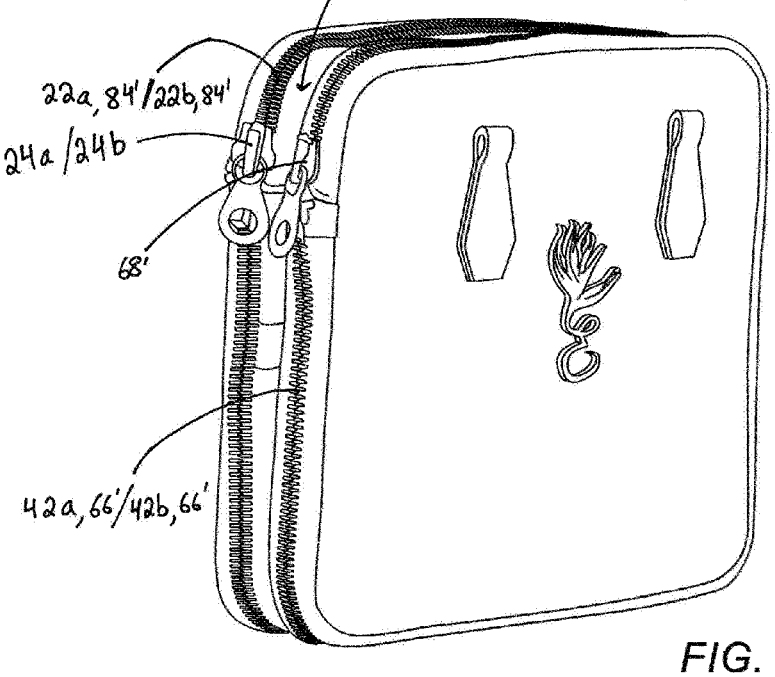

The structure and operation of the central members 50' is generally similar to that of the central member 50 unless expressly stated otherwise, and will be understood by analogy thereto. A specific feature of the central members 50' that is different from the central member 50 is that the central member 50' has a smaller width, dictated by the width of the peripheral sidewall 86'. In addition, the central member 50' lacks additional storage space defined by a plurality of inner sidewalls. The main function of the central member 50' is to act as a divider between the two side panels 10, 30 such that the handbag formed by attaching the side panels 10, 30 to the central member 50' is an expanded clutch. The expanded clutch is illustrated in FIGS. 17A and 17B.

Similar to the embodiments contemplated in which two or more central members 50 are attached to each other, embodiments are contemplated in which two or more central members 50' are attached to each other via the zipper engagement methodology described thus far in the present disclosure. Furthermore, embodiments are contemplated in which the central member 50 and the central member 50' are attached to each other via the zipper engagement methodology described thus far in the present disclosure.

Figure 18A:
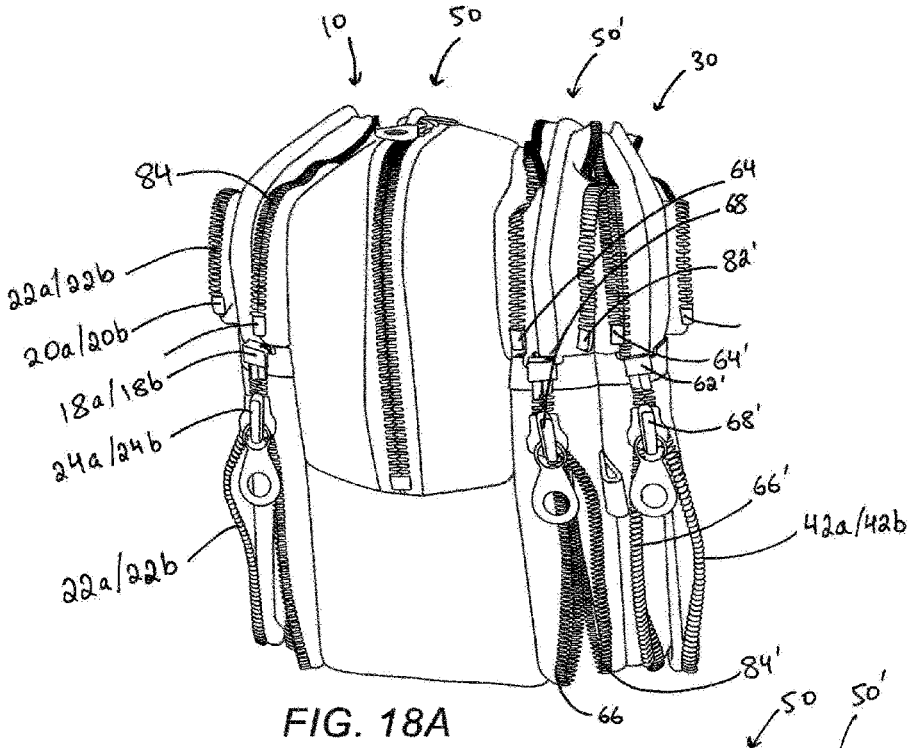
FIGS. 18A and 18B are side views of a handbag assembly, formed from the rear side panel, the front side panel, the central member of FIGS. 10-12, and the central member of FIGS. 15 and 16, the handbag assembly being shown in a zipper initial engaged state and a zipper closed state, respectively.
Figure 18B:
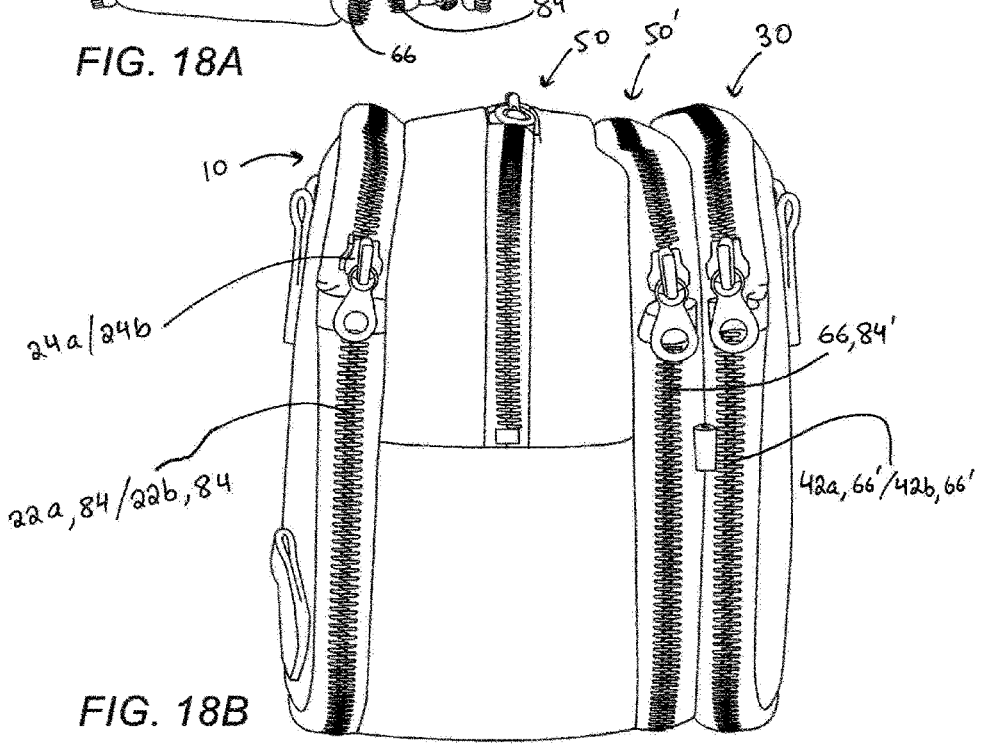

FIGS. 18A and 18B illustrate such an embodiment, in which the central member 50 is attached to the central member 50'. Specifically, the zipper arrangement 78' is engaged with the zipper arrangement 60 to form a zipper fastening arrangement. The rear side panel 10 is attached to the central member 50 via engagement of the zipper arrangement 78 with one of the zipper arrangements 16*a*, 16*b*. The front side panel 30 is attached to the central member 50' via engagement of the zipper arrangement 60' with one of the zipper arrangements 36*a*, 36*b*. As a result, three additional storage spaces formed, in addition to the storage space provided by the central member 50 accessible by the zipper arrangement 92. A first additional storage space is defined in part by the first outer sidewall 52 and the second outer sidewall 70'. A second additional storage space is defined in part by the second outer sidewall 70 and one of the outer sidewalls 14*a*, 14*b*. A third additional storage space is defined in part by the first outer sidewall 52' and one of the outer sidewalls 34*a*, 34*b*.

Although FIGS. 18A and 18B illustrate an embodiment in which a handbag is formed from a single central member 50, a single central member 50', and two side panels 10, 30, other embodiments are contemplated in which multiple central members 50, 50' are attached to each other in various combinations, via the zipper engagement methodology described thus far in the present disclosure. Such embodiments highlight the modularity, flexibility, customization and personalization of the handbags of the present disclosure.

Although embodiments of the present disclosure as described thus far have pertained to two reversible side panels 10, 30 that can be attached to each other in at least four attachment configurations, other embodiments are possible in which only one of the side panels is reversible. Such embodiments may be particularly advantageous when the side panels are implemented in larger sizes (i.e., larger than clutch side panels), for example, sizes constructed to hold mobile communication device having a large display screen, such as, for example, a tablet or laptop computing device.

Figure 19:
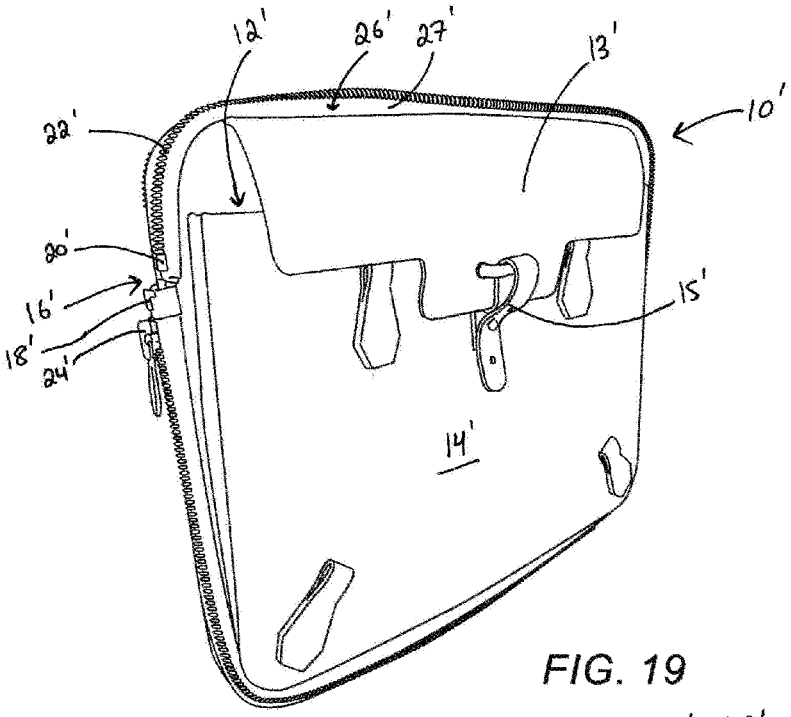
FIG. 19 is an isometric view of a rear side panel, constructed and operative according to another embodiment of the present invention.
Figure 20:
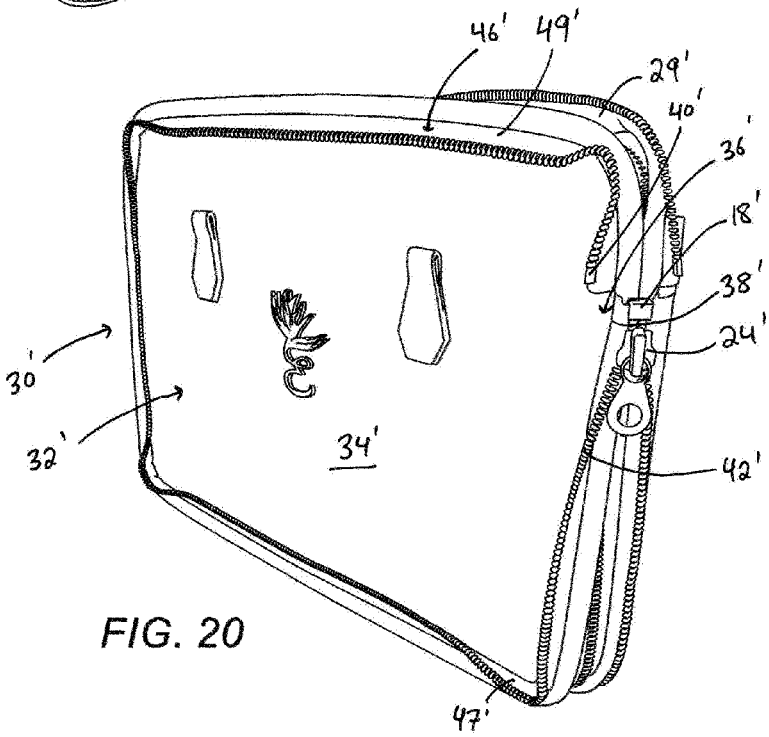
FIG. 20 is an isometric view of a front side panel, constructed and operative according to another embodiment of the present invention, the front side panel being attached to the rear side panel of FIG. 19 to form a handbag assembly.
Figure 21:
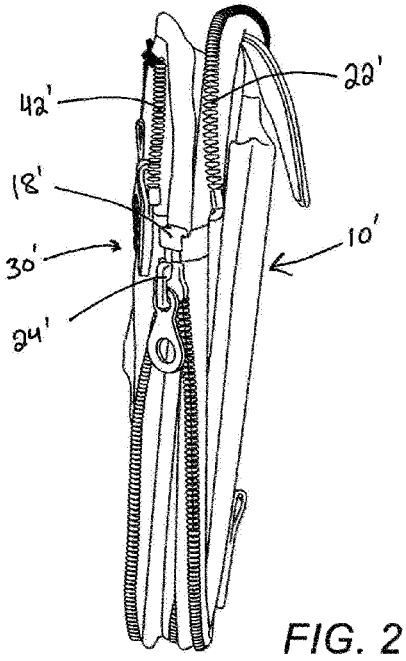
FIG. 21 is a side view of the handbag assembly of FIG. 20.

Referring now to FIGS. 19-21, a handbag and components thereof according to embodiment of the present disclosure. A side panel 10' is shown in FIG. 19. The structure of the side panel 10' is generally similar to that of the rear side panel 10 unless expressly stated otherwise, and will be understood by analogy thereto. A specific feature of the side panel 10' that is different from the rear side panel 10 is that a first outer sidewall 14' of the side panel 10' includes a pouch 12', dimensioned and sized to retain one of the aforementioned mobile communication devices. The side panel 10' further includes a flap 13' and corresponding engagement mechanism 15' deployed on the outer sidewall 14' for covering the pouch 12'. Although not shown in the drawings, similar components to those present on the first outer sidewall 14' are also present on the second outer sidewall of the side panel 10'.

A first peripheral flange 26' having an inner surface 27' and an outer surface 29' extends along almost the entire periphery of the outer sidewall 14', except for a small gap. A zipper arrangement of the first profile, designated 16', and referred to hereinafter as the zipper arrangement 16', is attached to the peripheral flange 26'. The zipper arrangement 16' includes a plurality of teeth 22' arranged to form a zipper track, a retainer box 18' deployed at a first end of the zipper track, an end post 20' deployed at a second end of the zipper track, and a slider 24' for moving along the teeth 22' between the retainer box 18' and the end post 20'.

A second side panel 30', attached to the side panel 10', is shown in FIGS. 20 and 21. The second side panel 30' is generally similar to that of the front side panel 30 unless expressly stated otherwise, and will be understood by analogy thereto. The second side panel 30' includes a first side 32' having an outer sidewall 34' disposed thereon. A peripheral flange 46' having an inner surface 47' and an outer surface 49' extends along almost the entire periphery of the second outer sidewall 34', except for a small gap. A zipper arrangement of the second profile, designated 36', and referred to hereinafter as the zipper arrangement 36', is attached to the peripheral flange 46'. The zipper arrangement 36' includes a plurality of teeth 42' arranged to form a zipper track, an insertion pin 38' deployed at a first end of the zipper track, and an end post 40' deployed at a second end of the zipper track. The second side panel 30' includes a second side (not shown), having features similar to those on the first side 32', as will be understood by analogous description of the second side 32*b* of the front side panel 30.

In the non-limiting attachment of the side panels 10', 30' illustrated in FIGS. 20 and 21, the zipper arrangement 16' is engaged with the zipper arrangement 36' to form a zipper fastening arrangement. A storage space is then formed by one of the outer sidewalls of the second side panel 30' and the outer sidewall opposite of the outer sidewall 14' of the side panel 10'. The resulting handbag forms a mobile communication device sleeve, which can be formed in at least four configurations.

Figure 22:
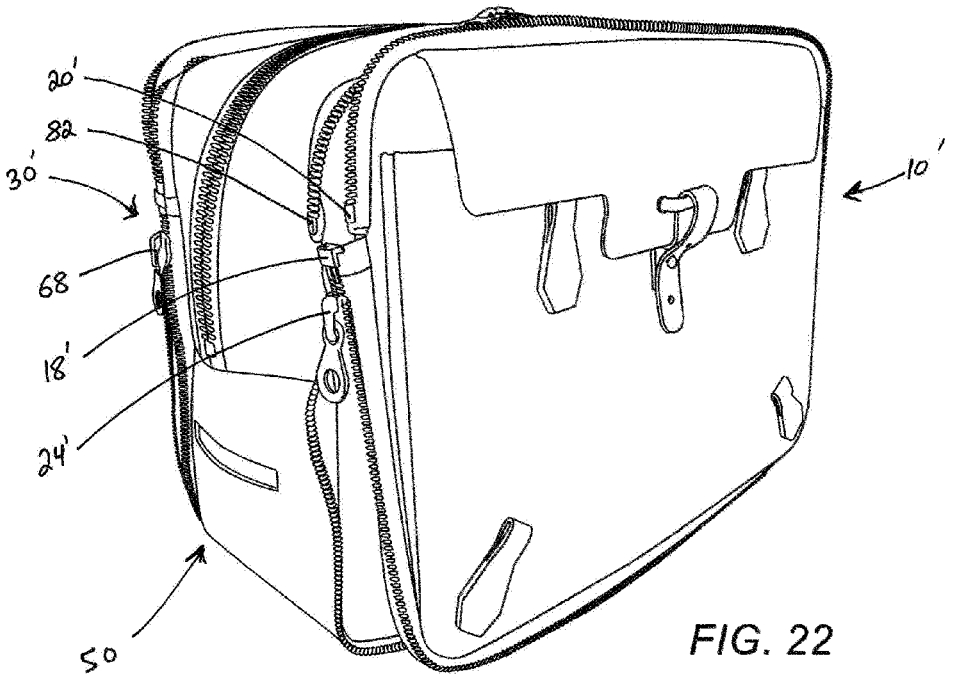
FIG. 22 is an isometric view of a handbag assembly, formed from the rear side panel of FIG. 19, the front side panel of FIG. 20, and a central member constructed and operative according to another embodiment of the present invention.

FIG. 22 illustrates the side panels 10', 30' attached to the central member 50 to form a larger mobile communication device handbag. The attachment of the side panels 10', 30' to the central member 50 is generally similar to that of the attachment described with reference to FIGS. 10-14B and will be understood by analogy thereto.

Figure 23:
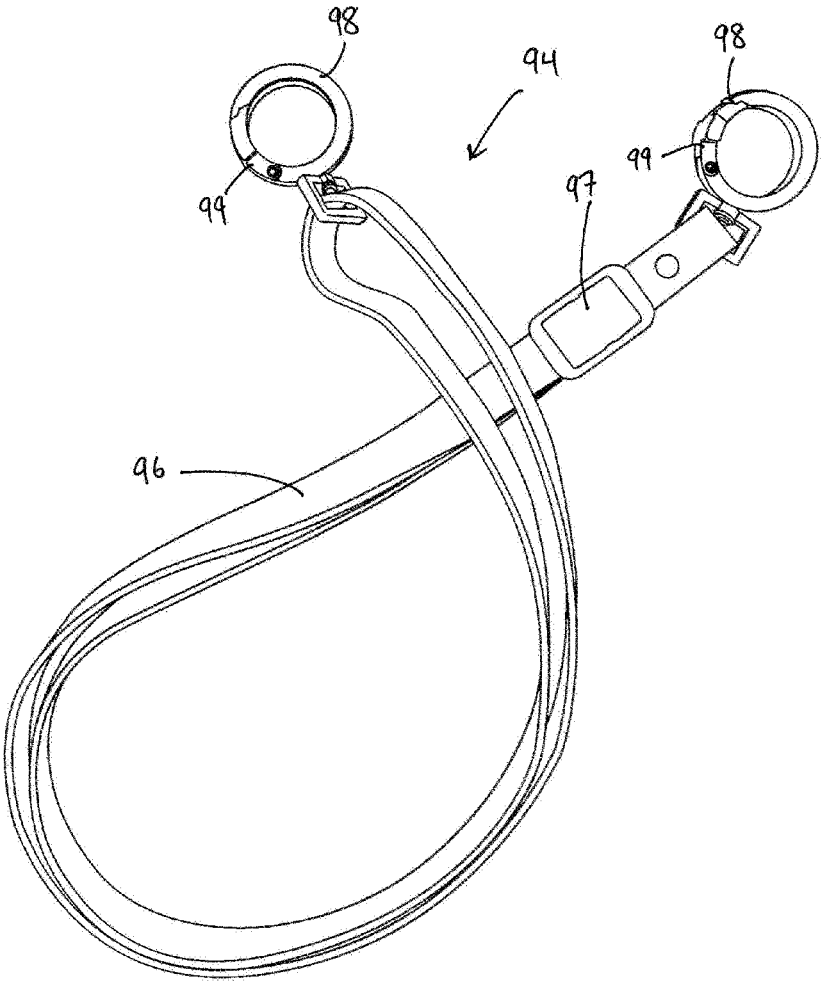
FIG. 23 is a front view of a strap assembly, constructed and operative according to an embodiment of the present invention, for detachably connecting with a strap connector of a rear side panel and a front side panel.

In the various embodiments of the handbag assembly described with reference to FIGS. 1-22, the side panels include various strap connectors (e.g., the strap connector 28*a*) to receive a detachable strap to allow carrying of the handbag assembly. FIG. 23 illustrates an example of a detachable strap assembly 94 for use with the strap connectors of the side panels. The strap assembly 94 includes a strap 96, which may be include a mechanism 97 for adjusting the length of the strap 96. The strap 96 may be constructed from a fabric or material (e.g., leather, elastic, denim, etc.) that matches the fabric or material from which the side panels 10, 10', 30, 30' are constructed. Each end of the strap 96 has a strap attachment mechanism 98 for attaching to a respective strap connector. In the non-limiting exemplary implementation shown in the drawings, the strap attachment mechanism 98 is implemented as a closed loop fastener having a displaceable portion 99 for hooking onto the respective strap connector (e.g., the strap connector 28*a*). The strap connector is correspondingly configured to receive the strap attachment mechanism 98, for example, via a permanently closed loop structure of the strap connector.

Although embodiments of the present disclosure as described thus far have pertained to two side panels 10, 30 having generally square-shaped outer sidewalls 14*a*, 14*b*, 34*a*, 34*b*, the shape of the outer sidewalls may be of various geometries, including, but not limited to, triangular and circular geometries. Furthermore, the central member 50 may be shaped corresponding to the size and shape of the side panels.

Figure 24:
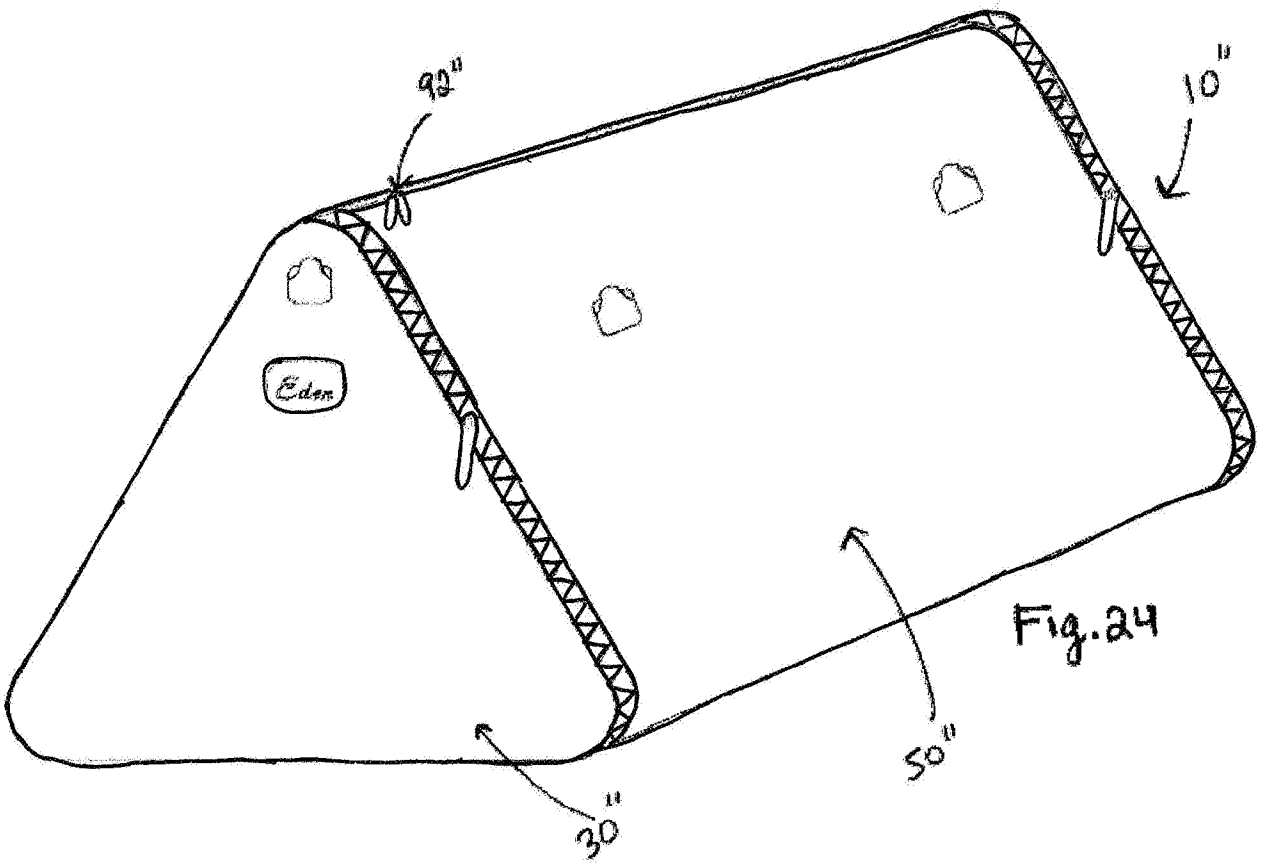
FIG. 24 is an isometric view illustrating a schematic representation of a handbag, formed from two triangular shaped side panels and an elongated central member having a triangular cross-section, according to an embodiment of the present invention.

Referring now to FIG. 24, an embodiment of a handbag assembly, in the form of a duffel bag, formed of two triangular shaped side panels 10", 30" and a central member 50". The structure of the side panels 10", 30" and the central member 50" are generally similar to that of the side panels 10, 30 and the central member 50, respectively, unless expressly stated otherwise, and will be understood by analogy thereto. A specific feature of the central members 50" that is different from the central member 50 is that the slider of the zipper arrangement 92" is arranged to move perpendicular to the plane of the outer sidewalls of the side panels 10", 30". A further feature of the central members 50" that is different from the central member 50 is that the central member 50" has a triangular shaped cross-section when taken in a first plane that is parallel to the outer sidewall surfaces of the side panels 10", 30". The central member 50" has a square or rectangular shaped cross-section when taken in a second plane normal to the firsts plane. In addition, the central member 50" is particularly useful when implemented as an elongated member, providing a large storage space accessible by the zipper arrangement 92".

Although not shown in the drawings, the side panels 10", 30" may be attached to each other without the central member 50" to form a triangular clutch-type handbag, similar to as described with reference to FIGS. 1-9. Furthermore, although not shown in the drawings, handbag assemblies similar to the assembly illustrated in FIG. 24 are contemplated, in which two side panels having corresponding geometric shape (e.g., circular, square, rectangular, hexagonal, etc.) are attached to each other with or without an elongated central member having a correspondingly shaped cross-section when taken in the plane parallel to the outer sidewall surfaces of the two side panels.

It should be emphasized that the handbag assemblies described in the present disclosure should not be limited to a particular size. In fact, the handbag assemblies may be produced in a wide range of sizes, from smaller sized assemblies advantageously used as clutch-type handbags, to larger sized assemblies advantageously used as luggage or suitcase type handbags. In certain embodiments, it may be advantageous to attach additional mechanisms to components of the handbag to increase mobility. For example, the lower portion of the central member may be outfitted with a base frame, constructed from, for example, metal, having a plurality of wheel connection points for receiving detachable wheels. The attachment and detachment of such wheels may be effectuated by a snap and lever release mechanism. The base frame may also include a handle connection surface for receiving a detachable handle. The attachment and detachment of the detachable handle may be effectuated by the same or similar mechanisms used for the attaching and detaching the wheels. Preferably, the detachable handle is a telescoping handle, allowing the user to quickly extend and retract the handle.

As mentioned above, the handbag assemblies of the present disclosure may include variety of handbags, including backpacks. FIGS. 25A-27 illustrate a particular embodiment of the present disclosure in which the handbag assembly takes the form of a modular backpack. The handbag assembly (i.e., backpack) includes a base panel 100, a first add-on panel 102, and a second add-on panel 104. The three panels 100, 102, 104 are separate members and are removably attachable to each other in various attachment configurations. The second add-on panel 104 is generally thinner than the first add-on panel 102, and is designed and dimensioned to carry smaller items than the items carried by the first add-on panel 102.

Figure 25A:
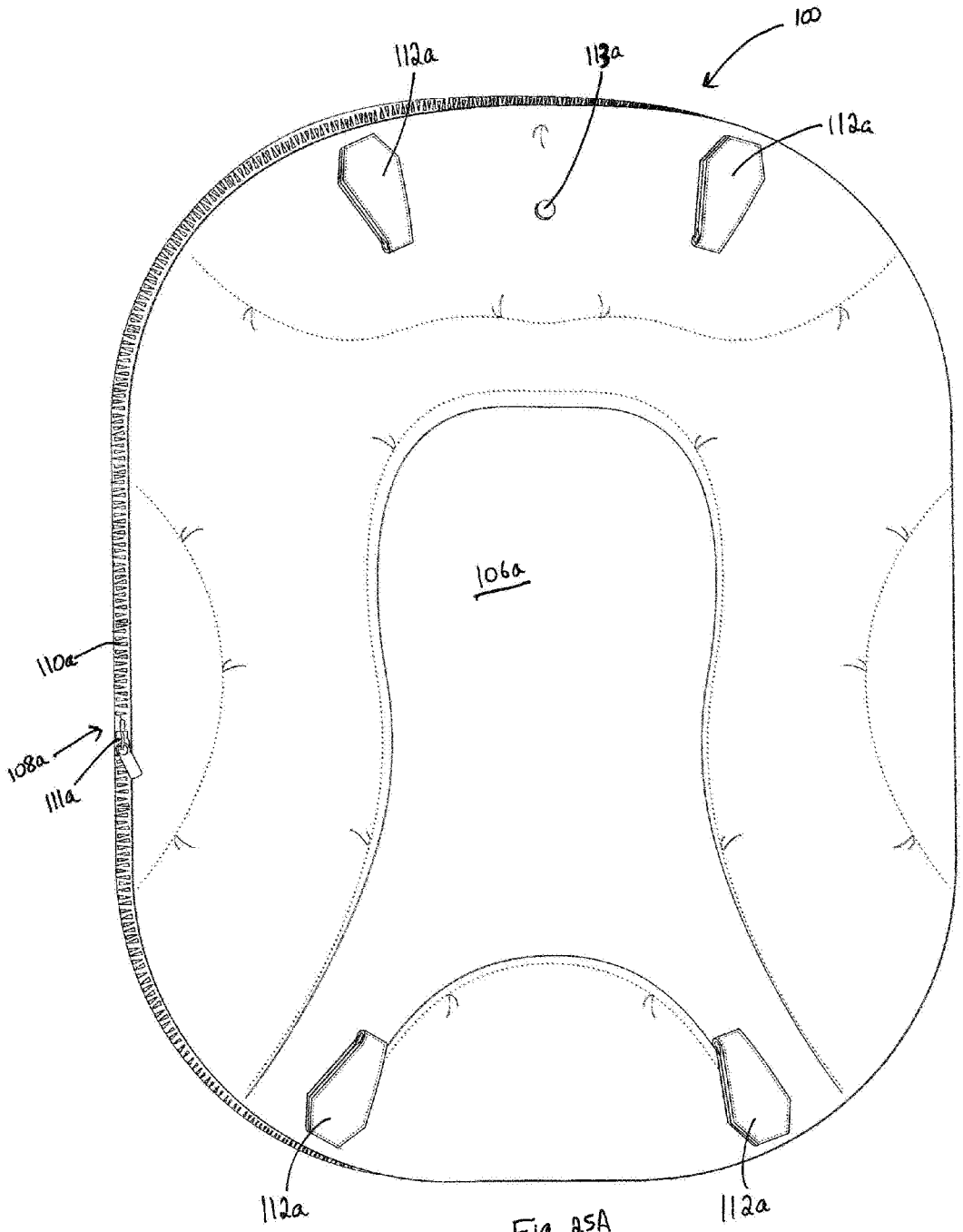
FIGS. 25A and 25B are front views illustrating a schematic representation of a base panel of a handbag assembly that forms a backpack, constructed and operative according to an embodiment of the present invention.

FIG. 25A shows the front and back sides of the base panel 100. The structure of the base panel 100 is generally similar to that of the rear side panel 10 unless expressly stated otherwise, and will be understood by analogy thereto. As such, the front side of the base panel 100 includes a first outer side wall 106*a* having a peripheral flange (not shown) to which a first zipper arrangement of the first profile, designated 108*a*, is attached. The zipper arrangement 108*a* includes a plurality of teeth 110*a* arranged to form a zipper track, a retainer box (not shown) deployed at a first end of the zipper track, an end post (not shown) deployed at a second end of the zipper track, and a slider 111*a* for moving between the two ends of the zipper track. A plurality of strap connectors 112*a* are deployed in spaced relation to each other, near the edges/corners of the first outer sidewall 106*a*.

The back side of the base panel 100 includes a second outer side wall 106*b* having a peripheral flange (not shown) to which a second zipper arrangement of the first profile, designated 108*b*, is attached. The zipper arrangement 108*b* includes a plurality of teeth 110*b* arranged to form a zipper track, a retainer box (not shown) deployed at a first end of the zipper track, an end post (not shown) deployed at a second end of the zipper track, and a slider 111*b* for moving between the two ends of the zipper track. A plurality of strap connectors 112*b* are deployed in spaced relation to each other, near the edges/corners of the first outer sidewall 106*b*.

Figure 25B:
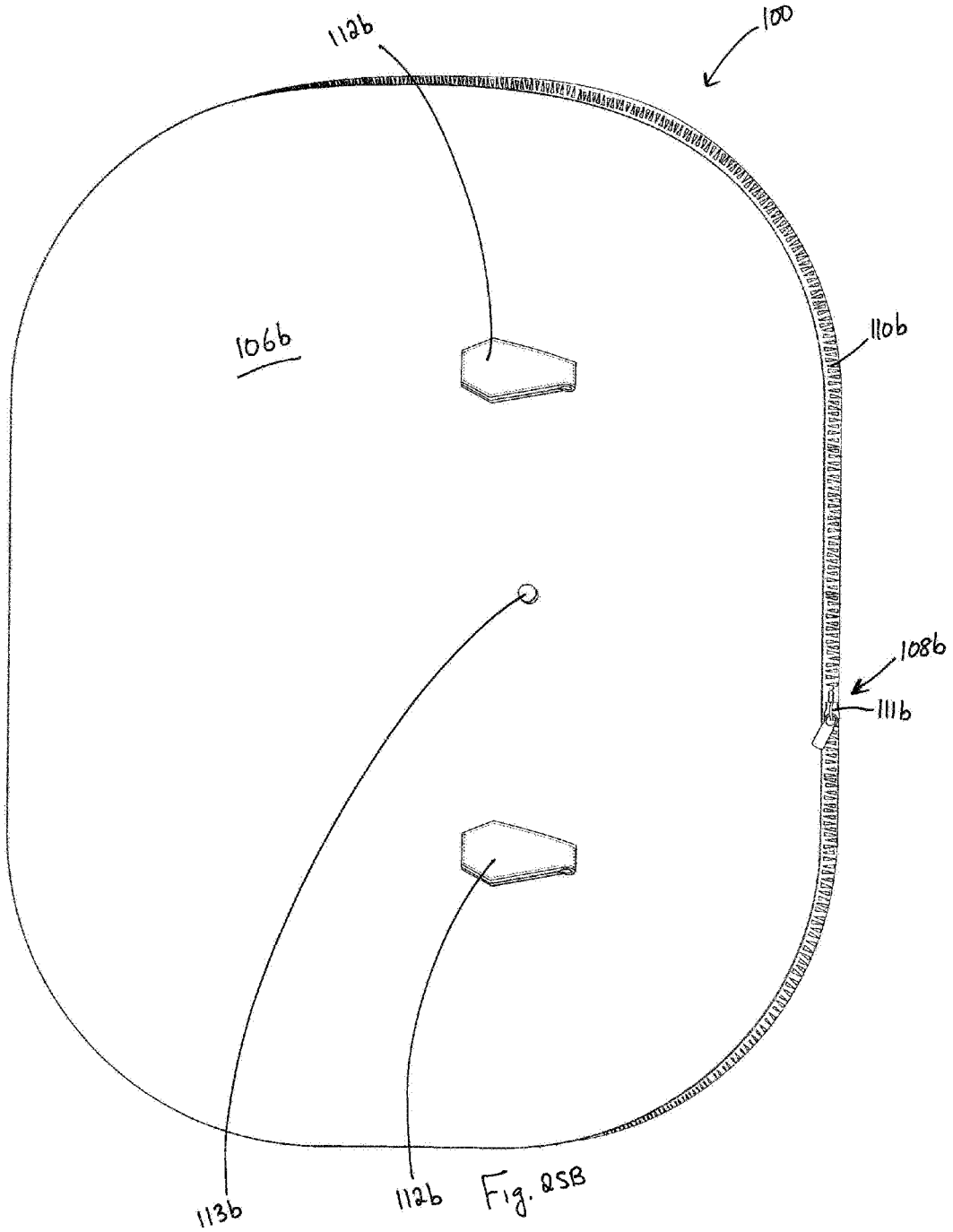

As can be seen in FIGS. 25A and 25B, the main distinguishing feature between the front side and the back side of the base panel 100 is the number of strap connectors. In effect, when the front side of the base panel 100 is exposed, the base panel 100 is intended to be worn as a backpack, whereas when the back side of the base panel 100 is exposed, the base panel 100 is intended to be worn as a shoulder back.

Figure 26:
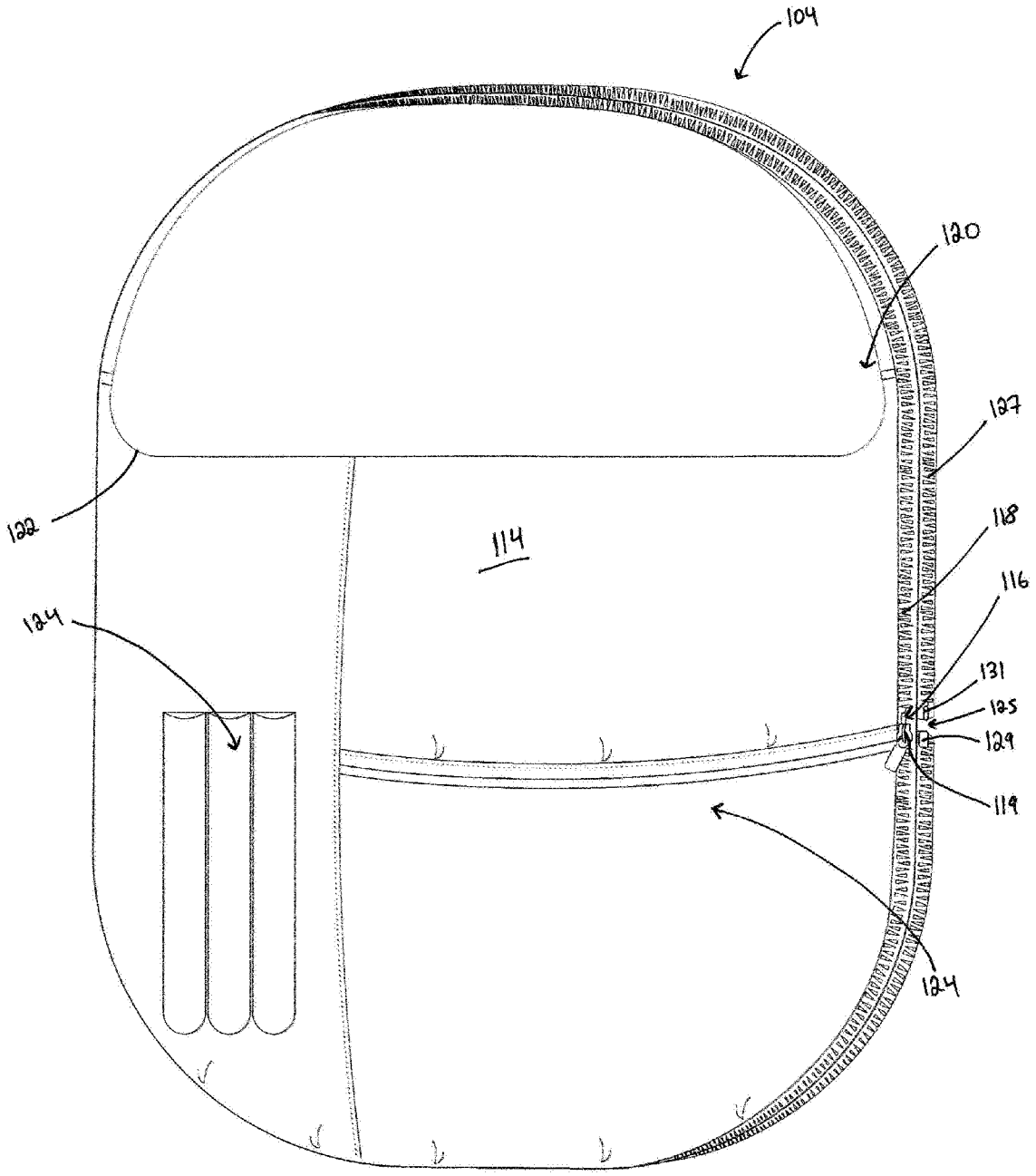
FIG. 26 is a front view illustrating a schematic representation of an add-on panel, constructed and operative according to an embodiment of the present invention, the add-on panel being attachable to the base panel of FIGS. 25A and 25B.

FIG. 26 shows the second add-on panel 104. The structure of the second add-on panel 104 is generally similar to that of the central member 50' unless expressly stated otherwise, and will be understood by analogy thereto. As such, the second add-on panel 104 includes a first outer sidewall 114, a second outer sidewall (not shown) opposite of the first outer sidewall 114, and a peripheral sidewall (not shown) extending between the two outer sidewalls.

A zipper arrangement of the first profile, designated 116, and referred to hereinafter as the zipper arrangement 116, is attached to a peripheral flange (not shown) of the first outer sidewall 114. The zipper arrangement 116 includes a plurality of teeth 118 arranged to form a zipper track, a retainer box (not shown) deployed at a first end of the zipper track, an end post (not shown) deployed at a second end of the zipper track, and a slider 119 for moving between the two ends of the zipper track. A zipper arrangement of the second profile, designated 125, and referred to hereinafter as zipper arrangement 125, is attached to a peripheral flange of the second outer sidewall. The zipper arrangement 125 includes a plurality of teeth 127 arranged to form a zipper track, an insertion pin 129 deployed at a first end of the zipper track, and an end post 131 deployed at a second end of the zipper track. Various features of the first and second outer sidewalls are not shown in drawings, but they should be self-evident given the analogous depiction of the central member 50' in FIGS. 15 and 16.

The first outer sidewall 114 includes a sleeve 120 covered by a moveable flap 122 for carrying a mobile communication device having a large display screen, such as, for example, a tablet or laptop computing device. The second add-on panel 104 further includes one or more compartments 124, accessible via respective zipper arrangements, as well as additional pouches, sleeves, and storage spaces for carrying and retaining office or school supplies (e.g., pens, pencils, calculators, etc.).

Figure 27:
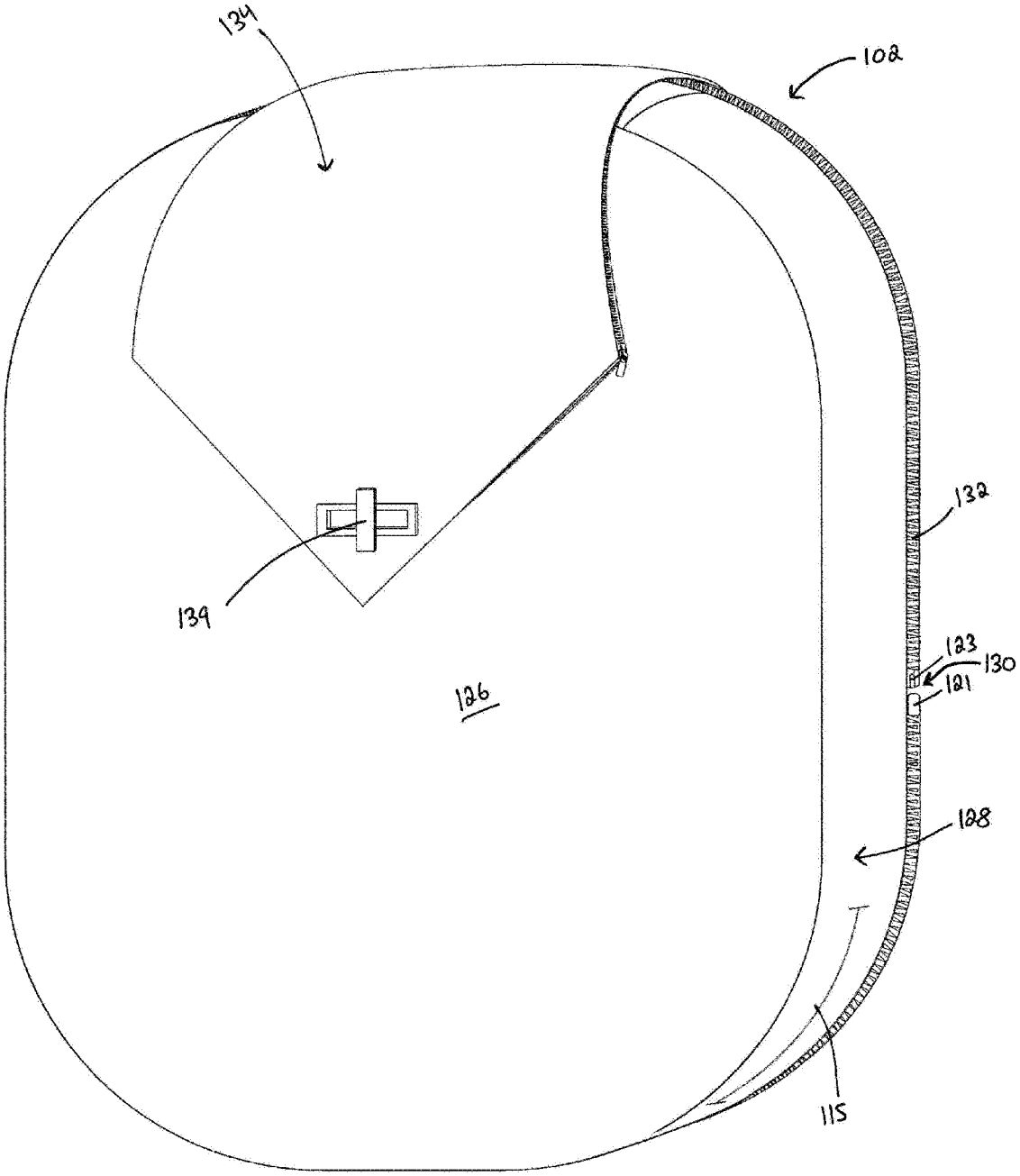
FIG. 27 is a front view illustrating a schematic representation of an additional add-on panel, constructed and operative according to an embodiment of the present invention, the additional add-on panel being attachable to either of the base panel of FIGS. 25A and 25B, or the add-on panel of FIG. 26.

As shown in FIG. 27, the first add-on panel 102 includes an outer sidewall 126 having a peripheral flange 128 formed thereon. Although not shown in the drawings, the first dd-on panel 102 also includes an inner sidewall oppositely disposed from the outer sidewall 126. The peripheral flange 128 extends along almost the entire periphery of the outer sidewall 126, except for a small gap. In certain embodiments, the outer sidewall 126 and the peripheral flange 128 gives the first add-on panel 102 the structure of a hollow shell, with the interior surface of the shell formed by the inner sidewall and an interior surface of the peripheral flange 128. In certain embodiments, the peripheral flange 128 includes a side pocket, in the form of a slit 115, for retaining a detachable elastic strap for holding a set of keys. A zipper arrangement of the second profile, designated 130, and referred to hereinafter as the zipper arrangement 130, is attached to the peripheral flange 128. The zipper arrangement 130 includes a plurality of teeth 132 arranged to form in a nearly closed loop, where the beginning and end of the nearly closed loop are marked by two respective ends of a zipper track. The zipper arrangement 130 includes an insertion pin 119 deployed at a first end of the zipper track, and an end post 121 deployed at a second end of the zipper track.

Although not shown in the drawings, in certain embodiments, the first add-on panel 102 is reversible, and can therefore assumer a first configuration (as shown in FIG. 27) and a second configuration. In the second configuration, the peripheral flange 128 is folded such that the outer sidewall 126 of the first configuration becomes the inner sidewall of the second configuration, and the inner sidewall of the first configuration becomes the outer sidewall of the second configuration.

Figure 28:
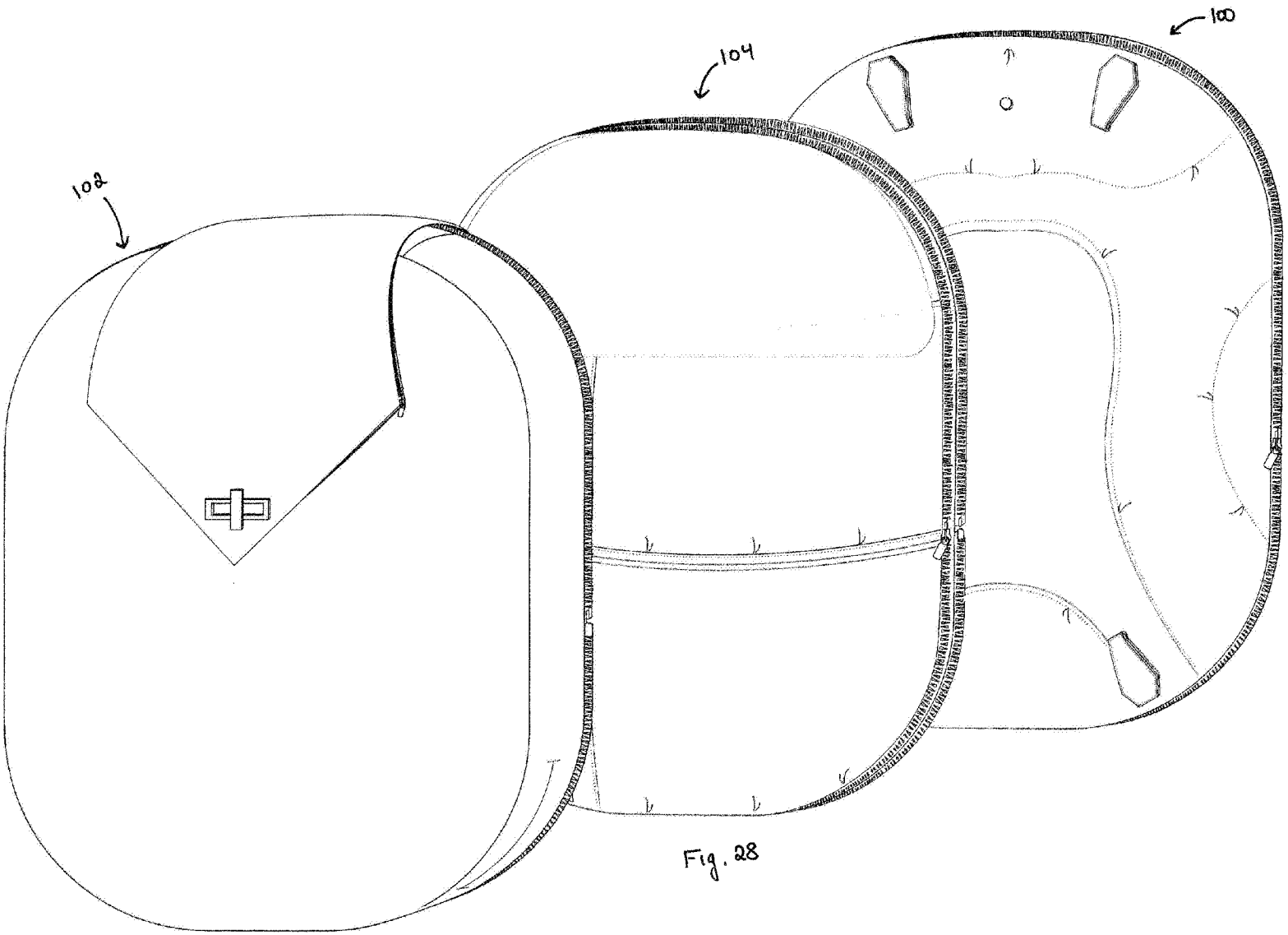
FIG. 28 is an isometric view illustrating a schematic representation of the three panels of FIGS. 25A-27 arranged to be attached to each other according to an attachment configuration according to an embodiment of the present invention.

The backpack may be formed in at least four different attachment configurations. FIG. 28 shows the arrangement of the three panels 100, 102, 104 when they are to be attached to each other according to a first configuration, in which the front side of the base panel 100 is attached to the second add-on panel 104 via corresponding zipper arrangements, and in which the second add-on panel 104 is attached to the first add-on panel 102 via corresponding zipper arrangements. A second attachment configuration may be used in which the back side of the base panel 100 is attached to the second add-on panel 104 via corresponding zipper arrangements, and in which the second add-on panel 104 is attached to the first add-on panel 102 via corresponding zipper arrangements. A third attachment configuration may be used in which the front side of the base panel 100 is attached directly to the first add-on panel 102 via corresponding zipper arrangements, without the intervening second add-on panel 104. A fourth attachment configuration may be used in which the back side of the base panel 100 is attached directly to the first add-on panel 102 via corresponding zipper arrangements, without the intervening second add-on panel 104.

As should be understood by analogous description of the handbag assemblies described with reference to FIGS. 1-22, the attachment configurations of the backpack are enabled by zipper fastening arrangements formed by zipper arrangements of the first and second profiles attached to the various outer sidewalls of the base panel 100, first add-on panel 102, and second add-on panel 104. The attachment configurations thereby provide storage spaces between the appropriate outer sidewalls. For example, in the first attachment configuration shown in FIG. 28, two such storage spaces are provided, namely a first storage space and a second storage space. The first storage space is defined by the first outer side wall 106*a* and the second outer sidewall of the second add-on panel 104. The second storage space is defined by the first outer sidewall 114 of the second add-on panel 104 and an outer sidewall of the first add-on panel 102 opposite of the outer sidewall 126.

It is noted herein that the outer sidewalls of the side panels, central members, add-on members, and base panels of the above described embodiments may include a variety of storage spaces and compartments, including compartments that can be opened and closed, and made accessible via, for example, zipper arrangements, hook and loop fasteners, snap mechanisms (e.g., male and female snap members), and magnetic pair fasteners, and open compartments, such as, for example, pouches, sleeves, and the like.

According to certain embodiments, an external detachable flap may be deployed to cover, and be removed from, the handbag assembly of the previously discussed embodiments. The flap may include one or more attachments mechanisms for providing removable attachment of the flap. The attachment mechanisms may be implemented in various ways, including, but not limited to, hook and loop fasteners, snap mechanisms (e.g., male and female snap members), magnetic pair fasteners, and twisting lock arrangements. The detachable flap, when attached to the handbag assembly, may be arranged to cover the exposed outer sidewalls of the handbag assembly. Therefore, it is preferred that the outer sidewalls of the side panels, central members, add-on members, and base panels include one or more components of the attachment mechanism and that detachable flap includes one or more corresponding components of the attachment mechanism, in order to facilitate the attachment and detachment of the removable flap.

Figures 29A, 29B, 29C:
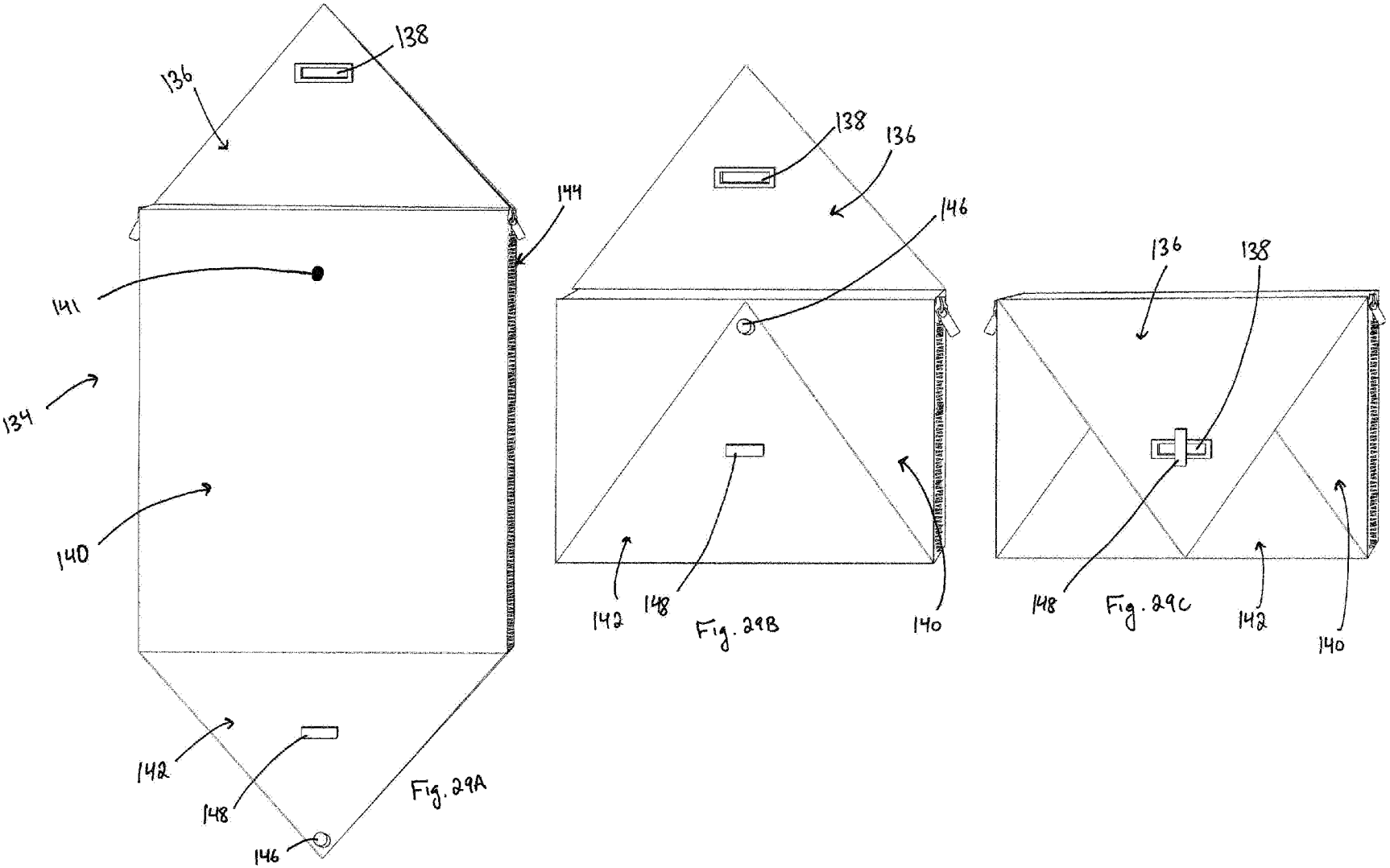
FIGS. 29A-29C are front views illustrating a schematic representation of a detachable flap, constructed and operative according to an embodiment of the invention, the detachable flap being removably attachable to one or more of the panels of FIGS. 25A, 25B and 28, and being shown in an unfolded, intermediate folded, and fully folded state, respectively.

FIGS. 29A-29C show a non-limiting example of a detachable flap 134 according to an embodiment of the present disclosure, attached to a handbag assembly in the form of a backpack, such as the backpack described above with reference to FIGS. 25A-28. The detachable flap 134 includes a first foldable portion 136 having a slot 138 that forms part of a twisting lock arrangement. A corresponding rotatable post 139 is attached to the outer sidewall 126 of the first add-on panel 102 and is insertable into the slot 138 in a first orientation and rotated to a second orientation to prevent removal of the detachable flap 134 from the first add-on panel 102.

In certain embodiments, the detachable flap 134 is double sided, meaning that the components present on one side of the detachable flap 134 are also present on the reverse side of the detachable flap 134.

FIG. 29A shows the detachable flap 134 in an unfolded state. As shown in FIG. 29A, the detachable flap 134 further includes a central portion 140 and a second foldable portion 142. The two foldable portions 136, 142 are configured to fold along opposing peripheral edges of the central portion 140. In certain embodiments, the foldable portions 136, 142 are triangular in shape. A storage space is provided within the central portion 140. The storage space is accessible via a first zipper arrangement 144 deployed on a peripheral edge of the central portion 140 adjacent to the edges along which the two foldable portions 136, 142 are configured to fold. The storage space may be additionally accessible via a second zipper arrangement deployed on an edge of the central portion 140 that is opposite to the edge on which the first zipper arrangement 144 is deployed.

A fastener 146 is deployed on a portion of the second foldable portion 142. The fastener 146 may be implemented in various ways, including, but not limited to, a first part of a snap mechanism configured to engage with a fastener 141 deployed on the central portion 140 that acts as a second part of the snap mechanism. The fastener 146 is also configured to engage with a corresponding fastener 113*a*, 113*b* deployed on the outer sidewalls 106*a*, 106*b* of the base panel 100 (FIGS. 25A and 25B). In such implementations, the fastener 146 can be a female snap member configured to engage with a corresponding male snap member deployed on the central portion 140 or with a corresponding male snap member deployed on the one of the outer sidewalls of the base panel 100. Alternatively, the fastener 146 can be a male snap member configured to engage with a corresponding female snap member deployed on the central portion 140 or with a corresponding female snap member deployed on the one of the outer sidewalls of the base panel 100.

The detachable flap 134 is convertible from a flap that covers the handbag assembly to a clutch-type purse. FIG. 29B shows the detachable flap 134 in an intermediate folded state, in which the second foldable portion 142 is folded, along its folding edge, to fold over the central portion 140, such that the fasteners 146, 141 engage with each other. FIG. 29C shows the detachable flap 134 in a fully folded state, in which the first foldable portion 136 is folded, along its folding edge, to fold over both the central portion 140 and the second foldable portion 142. A corresponding rotatable post 148, deployed on the reverse side of the second foldable portion 142, is inserted into the slot 138 in a first orientation, and subsequently rotated to a second orientation, thereby engaging the first and second foldable portions 136, 142. The resulting folded detachable flap 134 takes the form of a clutch-type purse, which can be unfolded and reattached to the handbag assembly (e.g., backpack) when not in use.

Note that although FIGS. 29A-29C illustrate the major components of the detachable flap 134 in an unfolded, intermediate folded, and fully folded state, respectively, the depictions of those components are a schematic representation, and therefore the components of the detachable flap 134, as illustrated in FIGS. 29A-29C, are not necessarily to scale.

Although embodiments of the present disclosure as described thus far have pertained to handbags constructed from side panels and other components to form assemblies that take a conventional form (e.g., clutch-type purse, purse, duffel bag, backpack, etc.), other embodiments are possible, in which two side panels are provided with corresponding zipper arrangements which enable attachment configurations resulting in handbags of atypical three-dimensional geometric configurations.

Figure 31:
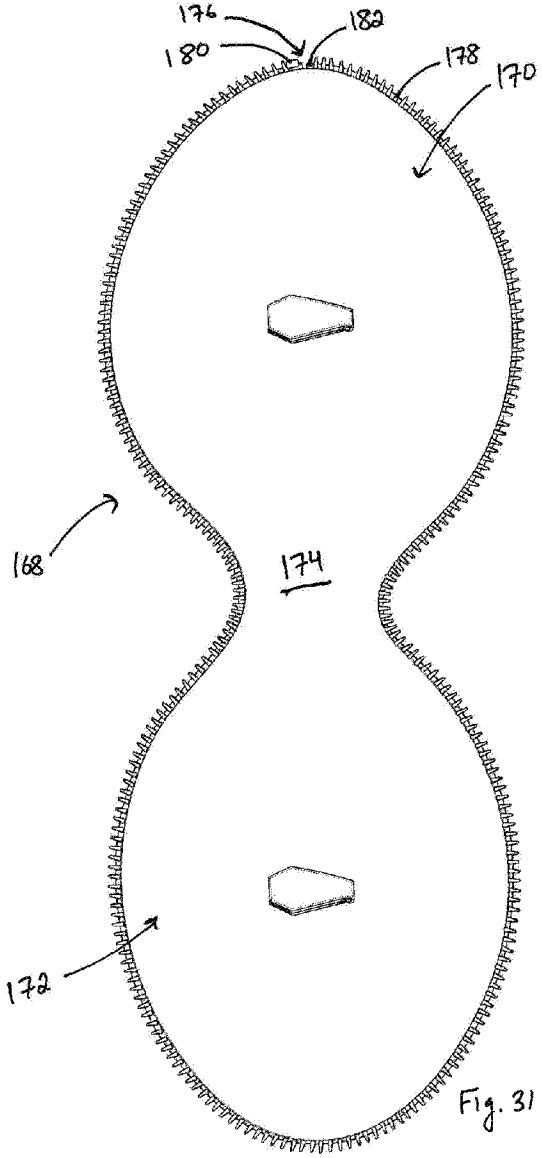
FIG. 31 is a front view illustrating a schematic representation of a second figure-eight shaped reversible side panel, constructed and operative according to an embodiment of the present invention.
Figure 30:
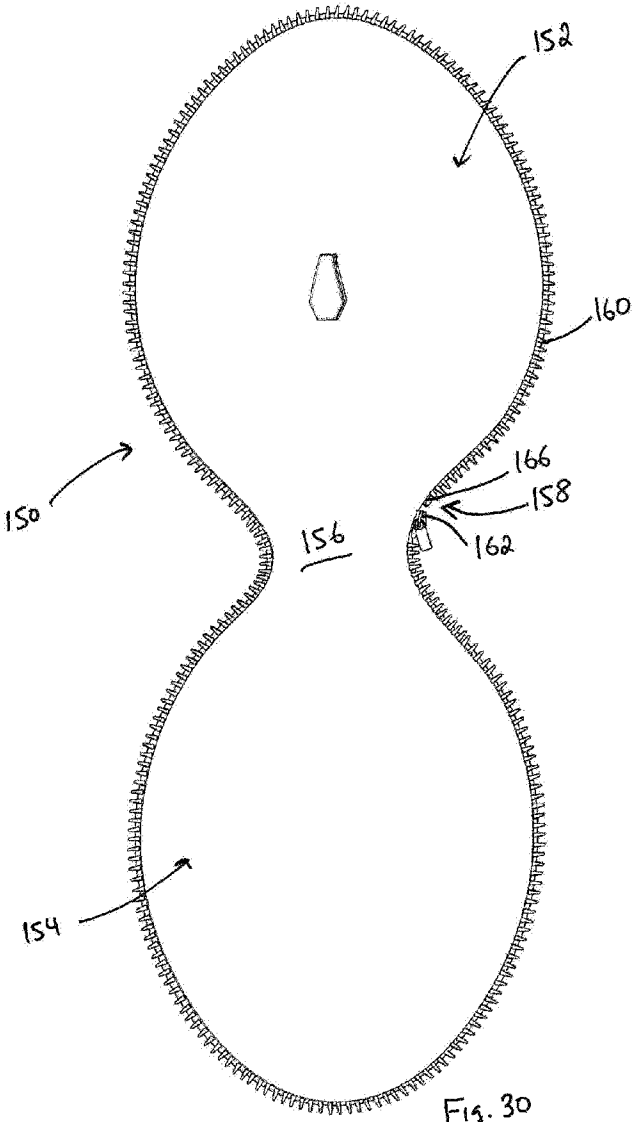
FIG. 30 is a front view illustrating a schematic representation of a first figure-eight shaped reversible side panel, constructed and operative according to an embodiment of the present invention.
Figure 32:
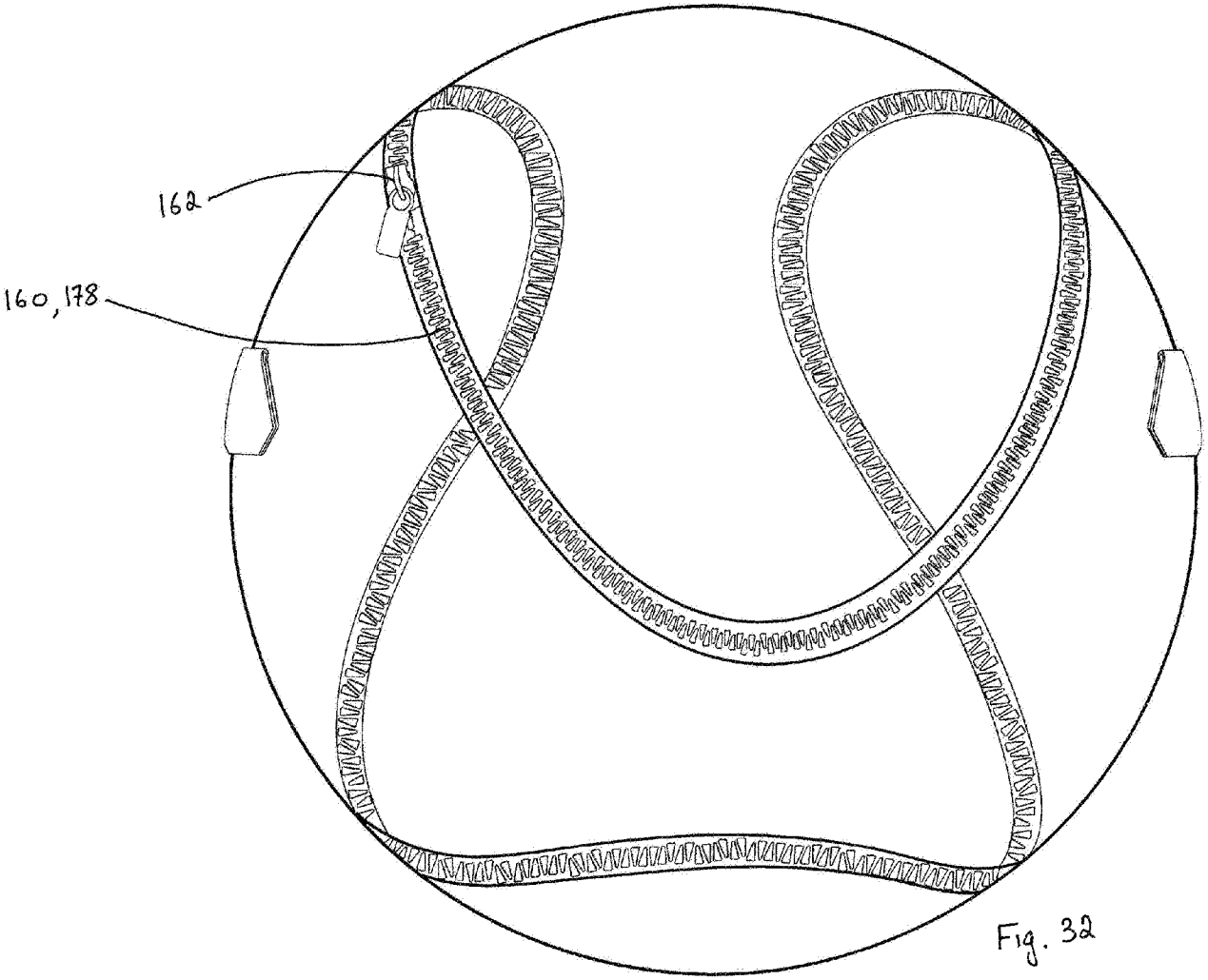
FIG. 32 is a schematic representation of a spherically shaped handbag assembly formed via attachment of the two figure-eight shaped reversible side panels of FIGS. 30 and 31.

Refer now to FIGS. 30-32, a handbag assembly according to an embodiment of the present disclosure that includes a first reversible side panel 150 and a second reversible side panel 168. The reversible side panels 150, 168 have the general shape of a figure eight, and are similarly dimensioned as sized.

As is shown in FIG. 30, the first side panel 150 includes two integrally formed oblong end portions, namely a first end portion 152 and a second end portion 154. The two end portions 152, 154 form a first outer sidewall 156. A zipper arrangement of the first profile, designated 158, and referred to hereinafter as the zipper arrangement 158 is attached to the first outer sidewall 156 along a peripheral portion thereof. Although not shown in the drawings, the first reversible side panel 150 includes a second outer sidewall, oppositely disposed from the first outer sidewall 156, and having a second zipper arrangement of the first profile attached to the second outer sidewall. Each of the two outer sidewalls of the first side panel 150 may have one or more strap connectors attached thereto for receiving one of the strap attachment mechanisms 98 of the detachable strap assembly 94.

The zipper arrangement 158 includes a plurality of teeth 160 arranged to form a zipper track, a retainer box (not shown) deployed at a first end of the zipper track, an end post 166 deployed at a second end of the zipper track, and a slider 162 for moving between the two ends of the zipper track. The retainer box and the end post 166 are deployed at a narrow section of the first side panel 150, where the two end portions 152, 154 are joined.

As is shown in FIG. 31, the first side panel 168 includes two integrally formed oblong end portions, namely a first end portion 170 and a second end portion 172. The two end portions 170, 172 form a first outer sidewall 174. A zipper arrangement of the second profile, designated 176, and referred to hereinafter as the zipper arrangement 176 is attached to the first outer sidewall 174 of the second reversible side panel 168 along a peripheral portion thereof. Although not shown in the drawings, the second reversible side panel 168 includes a second outer sidewall, oppositely disposed from the first outer sidewall 174, and having a second zipper arrangement of the second profile attached to the second outer sidewall. Each of the two outer sidewalls of the second side panel 168 may have one or more strap connectors attached thereto for receiving one of the strap attachment mechanisms 98 of the detachable strap assembly 94.

The zipper arrangement 176 includes a plurality of teeth 178 arranged to form a zipper track, an insertion pin 180 deployed at a first end of the zipper track, and an end post 182 deployed at a second end of the zipper track. The insertion pin 180 and the end post 182 are deployed at an edge portion of one of the two end portions 170, 172. As a result, when the side panels 150, 168 are brought together for attachment to form a handbag, the retainer box and the insertion pin 180 are in proximity with each other.

The two side panels 150, 168 are attached to each other via engagement of the zipper arrangements 158, 176, which forms a zipper fastening arrangement. As the slider 162 traverses along the zipper teeth 160, 178, the edges of the figure eight shaped side panels 150, 168 are joined together, resulting in a spherically shaped handbag. The resultant spherically shaped handbag is illustrated schematically in FIG. 32, with the side panels 150, 168 being shown as transparent in order to provide a clear view of the engaged zipper arrangements 158, 176.

Figures 33, 34:
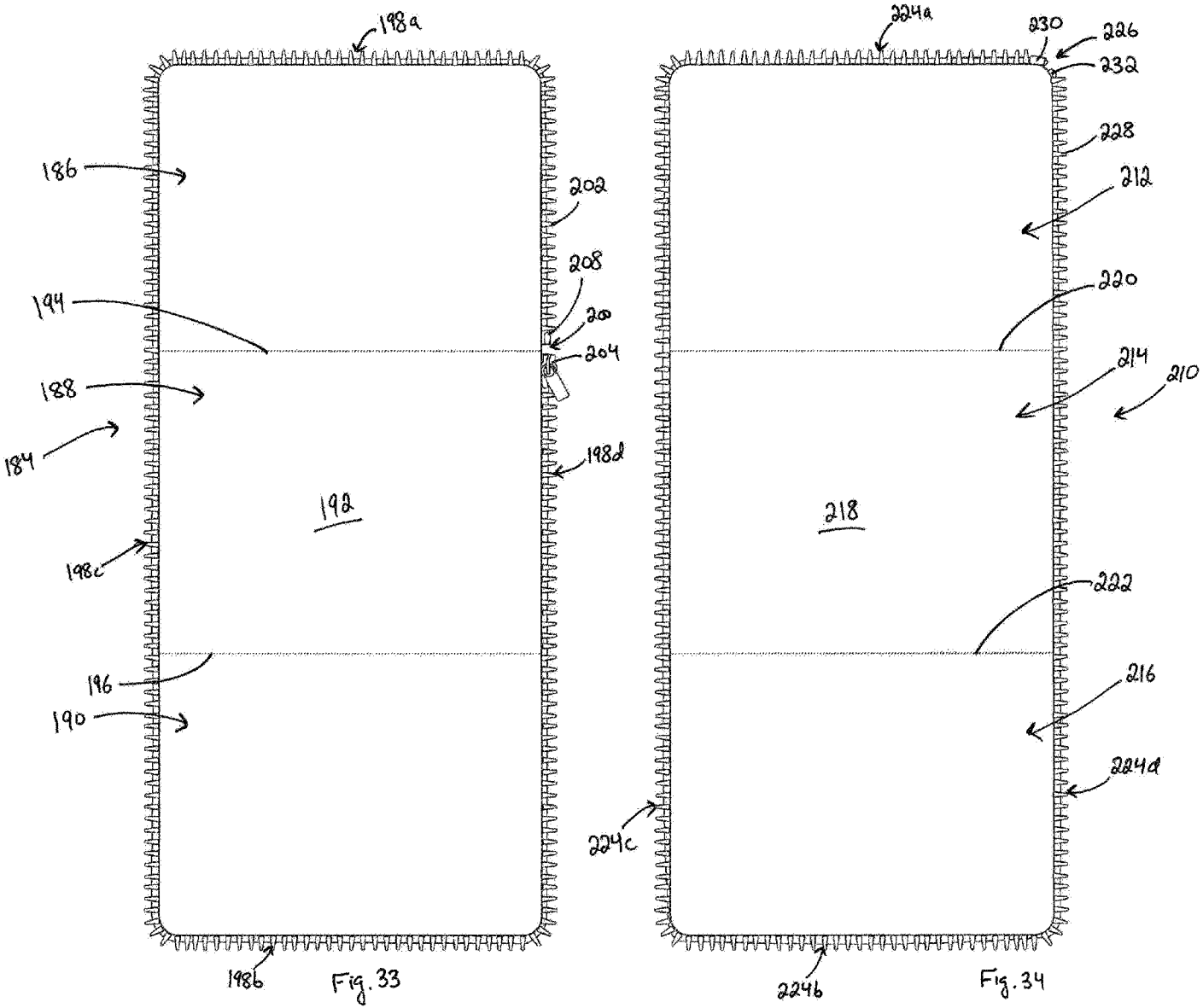
FIG. 33 is a front view illustrating a schematic representation of a first rectangular shaped reversible side panel, constructed and operative according to an embodiment of the present invention.
FIG. 34 is a front view illustrating a schematic representation of a second rectangular shaped reversible side panel, constructed and operative according to an embodiment of the present invention.
Figure 35:
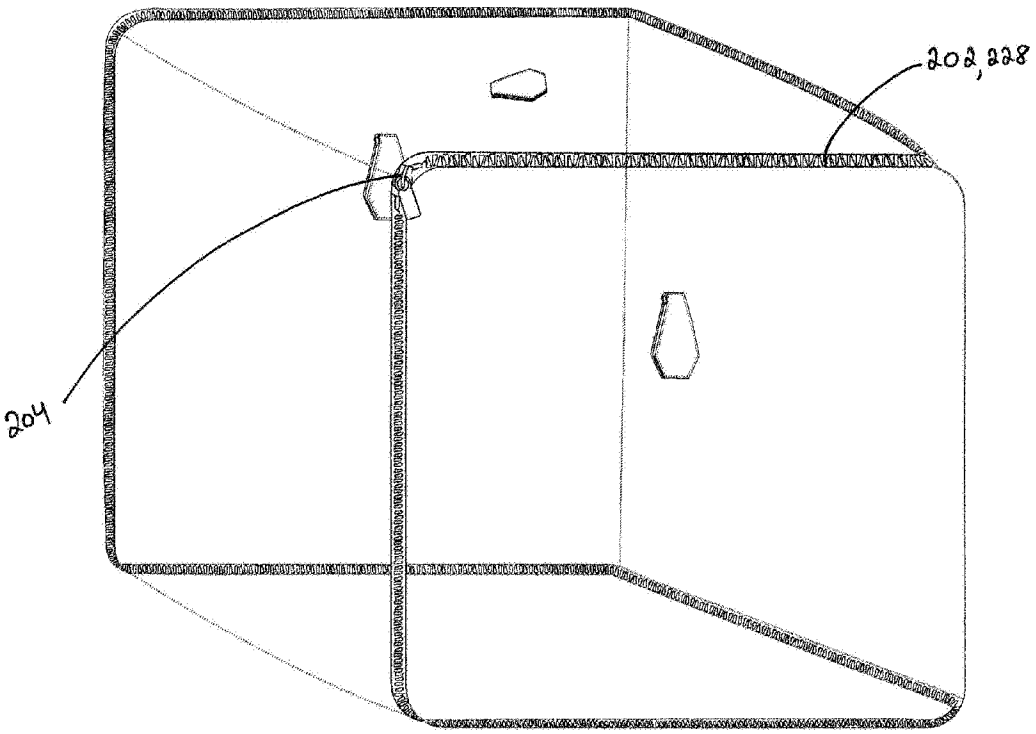
FIG. 35 is a schematic representation of a cubic handbag assembly formed via attachment of the two rectangular shaped reversible side panels of FIGS. 33 and 34.

FIGS. 33-35 show an alternative embodiment of a handbag assembly according to an embodiment of the present disclosure that includes a pair of reversible side panels 184, 210 that form a cubic handbag when attached to each other. The reversible side panels 184, 210 are generally rectangular in shaped, and are similarly dimensioned as sized.

As is shown in FIG. 33, the first side panel 184 includes three integrally formed portions, namely a first portion 186, a second portion 188, and a third portion 190. The three portions 186-190 form a first outer sidewall 192. Each of the three portions 186, 188, 190 is generally square in shape. The second portion 188 is a centralized portion that is connected to the first portion 186 along a first fold line 194 and is connected to the third portion 190 along a second fold line 196.

The first side panel 184 includes for edges, namely a top edge 198*a*, a bottom edge 198*b*, a left edge 198*c*, and a right edge 198*d*. The first portion 186 is bounded by the top edge 198*a*, the left edge 198*c*, the right edge 198*d*, and the first fold line 194. The second portion 188 is bounded by the left edge 198*c*, the right edge 198*d*, the first fold line 194, and the second fold line 196. The third portion 190 is bounded by the bottom edge 198*b*, the left edge 198*c*, the right edge 198*d*, and the second fold line 196.

A zipper arrangement of the first profile, designated 200, and referred to hereinafter as the zipper arrangement 200 is attached to the first outer sidewall 192 along a peripheral portion thereof (i.e., along the edges 198*a-d*). Although not shown in the drawings, the first reversible side panel 184 includes a second outer sidewall, oppositely disposed from the first outer sidewall 192, and having a second zipper arrangement of the first profile attached to the second outer sidewall. Each of the two outer sidewalls of the first side panel 184 may have one or more strap connectors attached thereto.

The zipper arrangement 200 includes a plurality of teeth 202 arranged to form a zipper track, a retainer box (not shown) deployed at a first end of the zipper track, an end post 208 deployed at a second end of the zipper track, and a slider 204 for moving between the two ends of the zipper track. The retainer box and the end post 208 are deployed along one of the edges 198*c*, 198*d* and proximate to one of the fold lines 194, 196. In the non-limiting exemplary illustration of the first side panel 184 shown in FIG. 33, the retainer box and the end post 208 are deployed along the right edge 198*d* and proximate to the first fold line 194. The retainer box is positioned slightly below or above the fold line 194, and the end post is positioned slightly above or below the fold line 194.

As is shown in FIG. 34, the second side panel 210 includes three integrally formed portions, namely a first portion 212, a second portion 214, and a third portion 216. The three portions 212-216 form a first outer sidewall 218. Each of the three portions 186, 188, 190 is generally square in shape. The second portion 214 is a centralized portion that is connected to the first portion 212 along a first fold line 220 and is connected to the third portion 216 along a second fold line 222.

The second side panel 210 includes for edges, namely a top edge 224*a*, a bottom edge 224*b*, a left edge 224*c*, and a right edge 224*d*. The first portion 212 is bounded by the top edge 224*a*, the left edge 224*c*, the right edge 224*d*, and the first fold line 220. The second portion 214 is bounded by the left edge 224*c*, the right edge 224*d*, the first fold line 220, and the second fold line 222. The third portion 216 is bounded by the bottom edge 224*b*, the left edge 224*c*, the right edge 224*d*, and the second fold line 222.

A zipper arrangement of the second profile, designated 226, and referred to hereinafter as the zipper arrangement 226 is attached to the first outer sidewall 218 along a peripheral portion thereof (i.e., along the edges 224*a-d*). Although not shown in the drawings, the second reversible side panel 210 includes a second outer sidewall, oppositely disposed from the first outer sidewall 218, and having a second zipper arrangement of the first profile attached to the second outer sidewall. Each of the two outer sidewalls of the first side panel 210 may have one or more strap connectors attached thereto.

The zipper arrangement 226 includes a plurality of teeth 228 arranged to form a zipper track, an insertion pin 230 deployed at a first end of the zipper track, and an end post 232 deployed at a second end of the zipper track. The insertion pin 230 and the end post 232 are deployed at a corner of the second side panel 210, i.e., at an intersection of two of the edges 224*a-d*. In the non-limiting exemplary illustration of the second side panel 210 shown in FIG. 34, the insertion pin 230 and the end post 232 are deployed at the top right corner of the second side panel 210, i.e., at the intersection of the top edge 224*a* and the right edge 224*d*.

The zipper arrangements 200, 226 are correspondingly configured and deployed such that, when the side panels 184, 210 are brought together for attachment to form a handbag, the retainer box and the insertion pin 230 are in proximity with each other. The two side panels 184, 210 are attached to each other via engagement of the zipper arrangements 200, 226, which forms a zipper fastening arrangement. As the slider 204 traverses along the zipper teeth 202, 228, corresponding edges 198*a-d*, 224*a-d* of the side panels 184, 210 are joined together, resulting in a cubic handbag. The resultant cubic handbag is illustrated schematically in FIG. 35, with the side panels 184, 210 being shown as transparent in order to provide a clear view of the engaged zipper arrangements 200, 226.

Although the major components of the handbag assemblies of the present disclosure have been described according to specific zipper arrangement deployment configurations in which, for example, the rear side panel 10 has zipper arrangements of the first profile attached thereto and the front side panel 30 has zipper arrangements of the second profile attached thereto, it should be apparent to one of ordinary skill in the art that other configurations are possible in which the rear side panel 10 has zipper arrangements of the second profile attached thereto and the front side panel 30 has zipper arrangements of the first profile attached thereto.

It should also be noted that, in some alternative implementations, the steps of the methods according to various embodiments of the present invention may be performed alternatively to the order as described above. For example, two steps which were described above as being performed in succession may, in fact, be performed substantially concurrently, or the steps may sometimes be performed in the reverse order, depending upon the functionality involved. Additionally, a single step may be performed as a series of sub-steps, performed sequentially or in parallel, depending upon the functionality involved.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

As used herein, the singular form, "a", "an" and "the" include plural references unless the context clearly dictates otherwise.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A handbag assembly comprising:

a first side panel member including:

oppositely disposed first and second outer sidewalls, a first zipper arrangement of a first profile coupled to the first outer sidewall along a peripheral portion thereof, and a second zipper arrangement of the first profile coupled to the second outer sidewall along a peripheral portion thereof, wherein the first and second zipper arrangements of the first profile are inversely oriented to each other such that the first side panel member is a reversible member, and wherein each of the zipper arrangements of the first profile includes a plurality of teeth extending substantially between a first end and a second end; and a second side panel member including:

oppositely disposed first and second outer sidewalls, a first zipper arrangement of a second profile coupled to the first outer sidewall of the second side panel member along a peripheral portion thereof, and a second zipper arrangement of the second profile coupled to the second outer sidewall of the second side panel member along a peripheral portion thereof, wherein the first and second zipper arrangements of the second profile are inversely oriented to each other such that the second side panel member is a reversible member, and wherein each of the zipper arrangements of the second profile includes a plurality of teeth extending substantially between a first end and a second end, wherein the first side panel member and the second side panel member are reversibly attachable to each other so as to be attachable to each other according to four attachment configurations, wherein the first zipper arrangement of the first profile is configured to engage with the first zipper arrangement of the second profile to form a zipper fastening arrangement such that the first side panel member and the second side panel member are attached to each other according to a first of the four attachment configurations and a compartment is created that is defined in part by the first outer sidewall of the first side panel member and the first outer sidewall of the second side panel member, wherein the second zipper arrangement of the first profile is configured to engage with the first zipper arrangement of the second profile to form a zipper fastening arrangement such that the first side panel member and the second side panel member are attached to each other according to a second of the four attachment configurations and a compartment is created that is defined in part by the second outer sidewall of the first side panel member and the first outer sidewall of the second side panel member, wherein the first zipper arrangement of the first profile is configured to engage with the second zipper arrangement of the second profile to form a zipper fastening arrangement such that the first side panel member and the second side panel member are attached to each other according to a third of the four attachment configurations and a compartment is created that is defined in part by the first outer sidewall of the first side panel member and the second outer sidewall of the second side panel member, and wherein the second zipper arrangement of the first profile is configured to engage with the second zipper arrangement of the second profile to form a zipper fastening arrangement such that the first side panel member and the second side panel member are attached to each other according to a fourth of the four attachment configurations and a compartment is created that is defined in part by the second outer sidewall of the first side panel member and the second outer sidewall of the second side panel member.

2. The handbag assembly of claim 1, wherein the engaging is defined in part by interlocking between the teeth of the at least one of the zipper arrangements of the first profile and the at least one of the zipper arrangements of the second profile.

3. The handbag assembly of claim 1, wherein each of the zipper arrangements of the first profile further includes a retainer box deployed at the first end, an end post deployed at the second end, and a slider for moving along the teeth between the first and second ends, and wherein each of the zipper arrangements of the second profile further includes an insertion pin deployed at the first end, and an end post deployed at the second end.

4. The handbag assembly of claim 3, wherein the engaging is defined in part by insertion of the insertion pin of one of the zipper arrangements of the second profile into the retainer box of one of the zipper arrangements of the first profile, and movement of the slider from the first end to the second end of one of the zipper arrangements of the first profile.

5. The handbag assembly of claim 3, wherein the teeth of each zipper arrangement of the first profile are arranged in a substantially closed loop, and wherein movement of the slider from the first end to the second end of each zipper arrangement of the first profile is in a clockwise direction along the closed loop.

6. The handbag assembly of claim 3, wherein the teeth of each zipper arrangement of the first profile are arranged in a substantially closed loop, and wherein movement of the slider from the first end to the second end of each zipper arrangement of the first profile is in a counter-clockwise direction along the closed loop.

7. The handbag assembly of claim 1, further comprising a central member having a plurality of sidewalls including at least oppositely disposed first and second outer sidewalls, wherein the central member further includes a third zipper arrangement of the second profile coupled to the first outer sidewall along a peripheral portion thereof, and a third zipper arrangement of the first profile coupled to the second outer sidewall along a peripheral portion thereof.

8. The handbag assembly of claim 7, wherein the third zipper arrangement of the second profile is configured to engage with at least one of the first and second zipper arrangements of the second profile to form a second zipper fastening arrangement and create a compartment defined in part by the first outer sidewall of the central member and at least one of the outer sidewalls of the first side panel, and wherein the third zipper arrangement of the first profile is configured to engage with at least one of the first and second zipper arrangements of the first profile to form a third zipper fastening arrangement and create a compartment defined in part by the second outer sidewall of the central member and at least one of the outer sidewalls of the second side panel and the first outer sidewall of the central member.

9. The handbag assembly of claim 1, wherein each of first and second outer sidewalls of each of the first and second side panels includes a pair of strap attachment mechanisms.

10. A handbag assembly comprising:

a central member including:

a plurality of sidewalls including at least oppositely disposed first and second outer sidewalls, a first zipper arrangement of a first profile coupled to the first outer sidewall along a peripheral portion thereof, and a first zipper arrangement of a second profile coupled to the second outer sidewall along a peripheral portion thereof; and an add-on side panel member including:

oppositely disposed first and second outer sidewalls, a second zipper arrangement of the second profile coupled to the first outer sidewall along a peripheral portion thereof, and a third zipper arrangement of the second profile coupled to the second outer sidewall along a peripheral portion thereof, wherein the second and third zipper arrangements of the second profile are inversely oriented to each other such that the add-on side panel member is a reversible member, wherein the add-on side panel member is reversibly attachable to the central member such that the add-on side panel member and the central member are attachable to each other according to two attachment configurations, wherein the second zipper arrangement of the second profile is configured to engage with the first zipper arrangement of the first profile to form a zipper fastening arrangement such that the add-on side panel member is attached to the central member according to a first of the two attachment configurations and a compartment is created that is defined in part by the first outer sidewall of the add-on side panel member and the first outer sidewall of the central member, and wherein the third zipper arrangement of the second profile is configured to engage with the first zipper arrangement of the first profile to form a zipper fastening arrangement such that the add-on side panel member is attached to the central member according to a second of the two attachment configurations and a compartment is created that is defined in part by the second outer sidewall of the add-on side panel and the first outer sidewall of the central member.

11. The handbag assembly of claim 10, wherein the central member further includes a first inner sidewall oppositely disposed from the first outer sidewall, and a second inner sidewall oppositely disposed from the second outer sidewall, and a compartment defined in part by the first and second inner sidewalls.

12. The handbag assembly of claim 10, wherein the central member further includes a third inner sidewall and a third outer sidewall oppositely disposed from the third inner sidewall, and wherein the compartment is further defined in part by the third inner sidewall.

13. The handbag assembly of claim 10, wherein the central member has a substantially triangular cross section through a first plane.

14. The handbag assembly of claim 13, wherein the central member has a substantially square or rectangular cross section through a second plane normal to the first plane.

15. A handbag assembly comprising:

a base panel member including oppositely disposed first and second outer sidewalls, the base panel member including:

a plurality of strap attachment mechanisms deployed on the first and second outer sidewalls for detachably receiving a plurality of straps, a first zipper arrangement of a first profile coupled to the first outer sidewall along a peripheral portion thereof, and a second zipper arrangement of the first profile coupled to the second outer sidewall along a peripheral portion thereof, wherein the first and second zipper arrangements of the first profile are inversely oriented to each other such that the base panel member is a reversible member; and a first add-on panel member including:

an outer sidewall, and a first zipper arrangement of a second profile coupled to the outer sidewall of the first add-on panel along a peripheral portion thereof, wherein the base panel member is reversibly attachable to the first add-on panel member such that the base panel member and the first add-on panel are attachable to each other according to two attachment configurations, wherein the first zipper arrangement of the second profile is configured to engage with the first zipper arrangement of the first profile to form a zipper fastening arrangement such that the base panel member is attached to the first add-on panel member according to a first of the two attachment configurations and a compartment is created that is defined in part by the outer sidewall of the first add-on panel member and the first outer sidewall of the base panel member, and wherein the first zipper arrangement of the second profile is configured to engage with the second zipper arrangement of the first profile to form a zipper fastening arrangement such that the base panel member is attached to the first add-on panel member according to a second of the two attachment configurations and a compartment is created that is defined in part by the outer sidewall of the first add-on panel member and the second outer sidewall of the base panel member.

16. The handbag assembly of claim 15, further comprising: a flap member removably attachable to the base panel member and the first add-on panel member.

17. The handbag assembly of claim 16, wherein the flap member includes: a central portion having a compartment with an opening at a first peripheral edge of the central portion, and a first foldable portion and a second foldable portion, each foldable portion configured to fold along a respective peripheral edge of the central portion that is adjacent to the first edge.

18. The handbag assembly of claim 1, wherein the zipper arrangements of the first profile and the zipper arrangements of the second profile exhibit counted teeth such that all of the zipper arrangements have a same number of teeth.

19. The handbag assembly of claim 10, wherein the first zipper arrangement of the first profile, the second zipper arrangement of the second profile, and the third zipper arrangement of the second profile exhibit counted teeth such that the first zipper arrangement of the first profile, the second zipper arrangement of the second profile, and the third zipper arrangement of the second profile have a same number of teeth.

20. The handbag assembly of claim 15, wherein the first zipper arrangement of the first profile, the second zipper arrangement of the first profile, and the first zipper arrangement of the second profile exhibit counted teeth such that the first zipper arrangement of the first profile, the second zipper arrangement of the first profile, and the first zipper arrangement of the second profile have a same number of teeth.

* * * * *